US005410848A

United States Patent [19]

McClinton et al.

[11] Patent Number: 5,410,848

[45] Date of Patent: * May 2, 1995

[54] COMPOSITE FOR TURNING A CORNER OR FORMING A COLUMN, MOLD AND METHOD FOR PRODUCING GLAZED UNIT FOR SUCH

[75] Inventors: John McClinton, Hanover; Russell P. Rich, Baltimore, both of Md.

[73] Assignee: The Burns & Russell Company, Baltimore, Md.

[ * ] Notice: The portion of the term of this patent subsequent to May 25, 2010 has been disclaimed.

[21] Appl. No.: 971,629

[22] Filed: Nov. 5, 1992

Related U.S. Application Data

[63] Continuation-in-part of Ser. No. 919,988, Jul. 27, 1992, Pat. No. 5,285,611, which is a continuation-in-part of Ser. No. 795,773, Nov. 21, 1991, Pat. No. 5,212,925.

[51] Int. Cl.[6] ..... E04C 1/00

[52] U.S. Cl. ..... 52/284; 52/604; 52/596; 52/610

[58] Field of Search ..... 52/604, 309.13, 309.17, 52/284, 596, 605, 609, 610, 611, 612

[56] References Cited

U.S. PATENT DOCUMENTS

| | | |
|---|---|---|
| 149,678 | 4/1874 | Rhodes . |
| 154,577 | 9/1874 | Billings . |
| 208,312 | 9/1878 | Hicks . |
| 252,747 | 1/1882 | Edwards . |
| 567,173 | 9/1886 | Schillinger . |
| 567,747 | 9/1896 | Lerch . |
| 629,337 | 7/1899 | Cartwright . |
| 657,802 | 9/1900 | Watson . |
| 784,476 | 3/1905 | Davis . |
| 790,480 | 5/1905 | Crouch . |
| 795,939 | 8/1905 | Shone . |
| 801,294 | 10/1905 | Ziegler . |
| 806,911 | 12/1905 | Phillips . |
| 834,573 | 10/1906 | Hall . |
| 894,122 | 7/1908 | Doughtery . |
| 987,319 | 3/1911 | Potter . |
| 1,064,498 | 6/1913 | Landis . |
| 1,097,148 | 5/1914 | Swanson . |
| 1,297,960 | 3/1919 | Yourtee . |
| 1,407,349 | 2/1922 | Levittman . |
| 1,644,586 | 10/1927 | Heltzel . |
| 1,644,587 | 10/1927 | Heltzel . |
| 1,719,620 | 7/1929 | Oesterla . |
| 1,751,028 | 3/1930 | Caswell et al. . |
| 2,120,200 | 6/1938 | Davis . |
| 2,121,450 | 6/1938 | Sentrop . |
| 2,126,012 | 8/1938 | Hedinger . |
| 2,205,730 | 6/1940 | Morgan . |
| 2,207,178 | 7/1940 | Richards . |
| 2,214,657 | 9/1940 | Brown . |
| 2,594,928 | 4/1952 | Horowitz . |

(List continued on next page.)

FOREIGN PATENT DOCUMENTS

| | | |
|---|---|---|
| 87006 | 11/1919 | Switzerland . |
| 673467 | 6/1952 | United Kingdom . |

*Primary Examiner*—Carl D. Friedman
*Assistant Examiner*—Wynn Wood
*Attorney, Agent, or Firm*—Pollock, Vande Sande & Priddy

[57] ABSTRACT

A composite comprising two glazed angled masonry building units. Each masonry building unit includes a glazed front face including a planar portion that is opposed a back face and a second segment that intersects the planar portion. The second segment forms an obtuse angle with the planar portion and has a length that is equal to or shorter than the length of the planar portion. A side face of the building unit is angled and intersects the second segment and the back face. This side face forms an obtuse angle with the back face and an angle with the second segment of the front face. Also provided is a mold and method for producing glazed masonry building units. In addition, a wall corner composite comprising one of the glazed angled masonry units and a mitred stretcher is provided.

Also included is a masonry building unit for use in constructing a structurally reinforced corner that includes a cut out portion.

47 Claims, 17 Drawing Sheets

U.S. PATENT DOCUMENTS

| | | | |
|---|---|---|---|
| 2,751,775 | 6/1956 | Sergovic | 52/596 |
| 2,752,275 | 6/1956 | Raskin et al. . | |
| 2,942,715 | 6/1960 | O'Connell . | |
| 3,102,367 | 9/1963 | Pedersen et al. | 52/594 |
| 3,324,619 | 6/1967 | Gearhart . | |
| 3,632,725 | 1/1972 | Jones | 52/309.12 |
| 3,720,028 | 3/1973 | Garay et al. . | |
| 3,722,704 | 3/1973 | Piretti . | |
| 3,992,834 | 11/1976 | Valenzano | 52/314 |
| 4,031,289 | 6/1977 | Sergovic . | |
| 4,075,812 | 2/1978 | Koyama et al. . | |
| 4,125,972 | 11/1978 | Pate . | |
| 4,258,522 | 3/1981 | Amaral . | |
| 4,329,822 | 5/1982 | Russell | 52/309.16 |
| 4,416,097 | 11/1983 | Weir . | |
| 4,614,324 | 9/1986 | Yamashita et al. . | |
| 4,673,159 | 6/1987 | Schmidgall . | |
| 4,698,949 | 10/1987 | Dietrich | 52/604 |
| 4,790,110 | 12/1988 | Bard | 52/612 |
| 4,833,856 | 5/1989 | Zwagerman | 52/604 |
| 4,909,010 | 3/1990 | Gravier . | |
| 5,031,376 | 7/1991 | Bender et al. . | |
| 5,173,003 | 12/1992 | Hair | 52/604 |
| 5,193,931 | 3/1993 | Arato . | |

FIG. 2
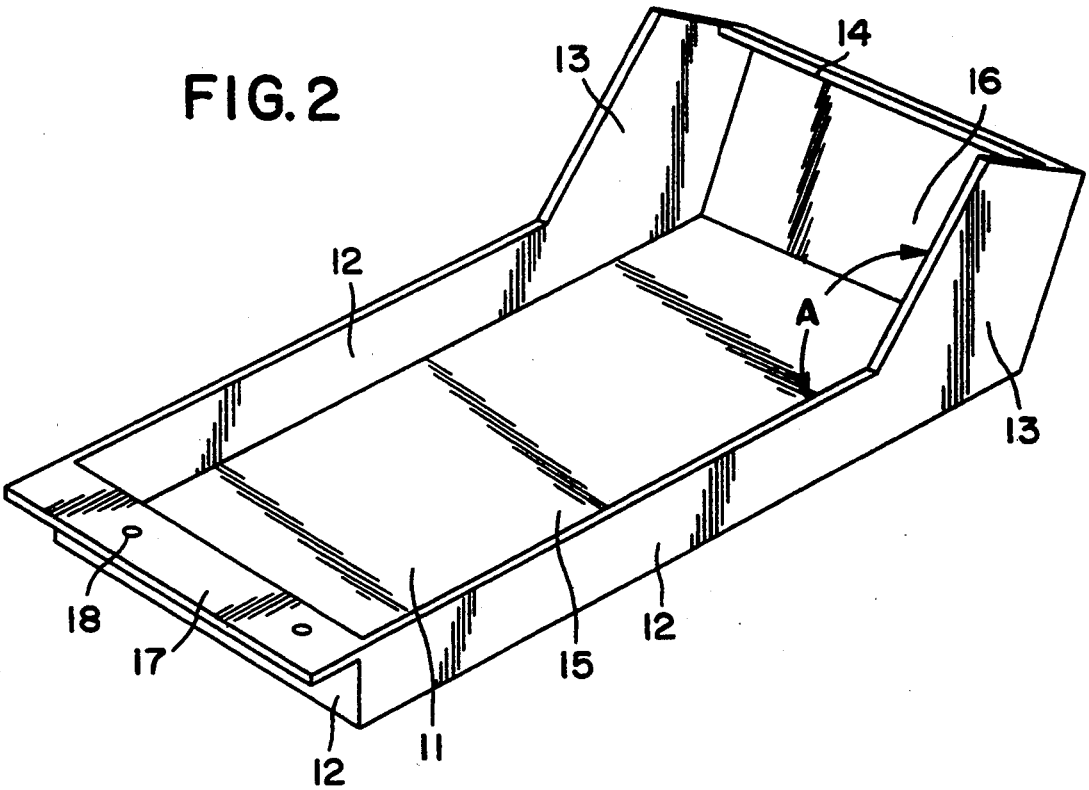
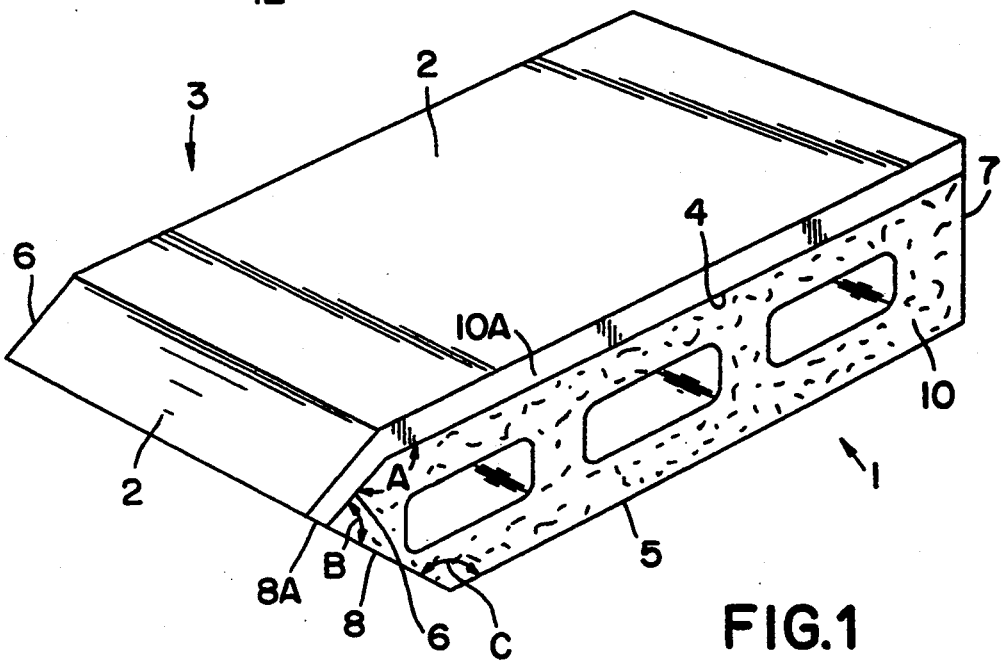
FIG. 1

COMPOSITE FOR TURNING A CORNER OR FORMING A COLUMN, MOLD AND METHOD FOR PRODUCING GLAZED UNIT FOR SUCH

CROSS-REFERENCE TO RELATED APPLICATIONS

This is a continuation-in-part of U.S. application Ser. No. 919,988 filed Jul. 27, 1992, now U.S. Pat. No. 5,285,611 and entitled "Wall Corner Composite, Mold and Method for Producing Glazed Unit For Such," which in turn is a continuation-in-part of Ser. No. 07/795,773 filed Nov. 21, 1991, now U.S. Pat. No. 5,212,925 and entitled "Wall Corner Composite, Mold and Method for Producing Glazed Unit for Such," entire disclosures of which are incorporated herein by reference.

DESCRIPTION

1. Technical Field

The present invention is concerned with forming corners in a wall construction containing at least two glazed masonry building units of particular configuration. In addition, the present invention is concerned with columns or portions thereof constructed from at least two glazed masonry building units of particular configuration. The present invention is also concerned with a mold and method for providing the glazed masonry building units employed to provide the wall corner construction of the present invention. The present invention is also concerned with masonry building units, including glazed and unglazed units, for forming reinforced corners in a wall construction.

2. Background Art

Filled polymeric materials have been known to provide decorative and protective surfaces to walls. For instance, it has been known to coat masonry units filled with polyesters and to form walls therefrom. The basic patent on the use of polyester as coatings for masonry units is U.S. Pat. No. 2,751,775 to Sergovic and assigned to the assignee of the present application. Over the years, a number of improvements in the coating compositions for the masonry building units have been developed. For instance, U.S. Pat. No. 3,328,231 to Sergovic and assigned to the assignee of the present application, discloses a glazed masonry building block made of a cured composition of an unsaturated polyester resin and sand in which the sand comprises at least 50% by weight of the coating composition. The unsaturated polyester is derived from a reaction between a dicarboxylic acid, such as phthalic, maleic, fumaric, adipic, pimelic, suberic, itaconic, citraconic, succinic acids, and/or an anhydride thereof, and a polyhydric alcohol such as ethylene glycol, diethylene glycol, and propylene glycol. Also present in such compositions is an unsaturated monomer, such as methyl methacrylate, styrene, diallyl phthalate, t-butyl styrene,and alphamethyl styrene. Furthermore, U.S. Pat. No. 4,031,289 to Sergovic discloses coated masonry building blocks, articles and compositions therefore that employ various pigments and chemicals in combination with various resinous compositions to provide stain resistance when subjected to high moisture conditions and/or staining media. The disclosures of the above mentioned U.S. Pat. Nos. 2,751,775, 3,328,231 and 4,031,289 are incorporated herein by reference.

Constructing walls with glazed masonry building units presents particular problems with respect to the formation of the outside corners of the wall structures. For example, glazed cinder or concrete blocks at corners and intersecting wall planes must be glazed on more than one side, in particular one face and one end or one face and one top provided that they are intersecting, in order for the glaze material to show when turning a corner. However, attempts to glaze two intersecting sides of a masonry block have not been entirely successful and have suffered from a number of problems. For example, the percent of factory culls or rejects generated when making a corner or cap block with two or more surfaces glazed simultaneously is significantly greater than the percent of culls generated when glazing a single face or plane to form a straight wall unit (referred to in the art as "stretchers").

When making a unit with two intersecting glazed planes, a mold which also has two intersecting planes is used. The space between the vertical plane of the mold and the concrete block requires special care when filling to assure the removal of entrapped air in the glazing material. This results in air bubbles which become pinholes in the return end of corner units. Also, the differences in sand settlement can cause unsightly lines at the intersecting planes of the corner.

Rejected glazed corner blocks result in a 5% to about 10% loss as compared to only a 0.5% to about 2% loss for coated "stretchers." In particular, defects in the finished products are manifested as the formation of unsightly lines at the intersecting planes of the decorative surfaces of the corner units, unsightly pin holes and differences in the color appearance between the intersecting surface planes of such blocks.

One attempt to overcome the problems associated with constructing the outside corners is disclosed in U.S. Pat. No. 4,329,822 to Russell and assigned to the assignee of the present application. In particular, U.S. Pat. No. 4,329,822 discloses a corner wall facing unit that includes a unit that it is not supported by a concrete block and must be supported using a non-block supported wall system or wire mesh and is time-consuming to erect. Although such a system has been quite effective, such non-self-supporting units tended to be relatively heavy for their size which requires the use of temporary wedges to prevent slippage and sagging in the mortar used between the wall units during erection. Also, such units require special installation care,and do not assure structural integrity equal to this system and other conventional systems.

Moreover, turning a corner, e.g.— a 90° corner or more, has been carried out by employing a single piece angled glazed block in conjunction with a glazed straight wall unit (see FIG. 7). Such a corner would be used to create a wall angle in the exposed face by employing only one angled glazed block and will always be connected to a straight wall unit without the use of a second corner piece or angled glazed block. The return employed on these prior angled glazed blocks are relatively deep, i.e. at least about 3¾". The use of such a single piece angled glazed block normally requires a fill piece adding to the complexity of the arrangement. The prior angled glazed blocks are merely an angled version of the 90°4", 6", 8" or 12" single corner square or rounded units.

SUMMARY OF INVENTION

The present invention overcomes many of the problems in the prior art and provides for a system that utilizes a composite or construction of two glazed angled masonry units for constructing a corner, which exhibits a superior looking wall and corner along with a higher level of acceptance at the job site and a reduced percentage of rejected materials at the manufacturing site. Moreover, when two walls intersect at right angles the present invention provides for eliminating a mortar joint at the extreme corner if corners are mitred and moves the mortar joint to a flat plane connecting the two intersecting wall planes. This is more architecturally aesthetic than the traditional mortar joint falling directly at the extreme intersection of the two planes. In addition, the present invention makes it possible to achieve the benefits of a mitre joint on the integral wall construction without the problems of having a mortar joint visible at the extreme corner of the construction, and without using the connecting unit of U.S. Pat. No. 4,329,822 as a spacer to turn the corner.

In addition, the present invention provides for having self-supporting main wall units integrated.

In an alternative embodiment, the present invention is concerned with providing an angled masonry unit for use in constructing a corner that is structurally reinforced. The angled masonry unit for this purpose can be unglazed (i.e.—raw block) but preferably is glazed.

More particularly, one aspect of the present invention is concerned with a wall corner composite employing at least two glazed angled concrete block masonry building units. Each of the glazed raw block masonry building units include a front face, a back face, a top face, a bottom face and two side faces. To form the glazed masonry unit, the front face is glazed with a resinous composition and is intended to be exposed as the main wall unit and includes a planar surface that is opposite the back face and preferably extends parallel to the back face (raw block) and a second glazed surface that intersects the planar portion at a right, obtuse or acute angle. The length of the second segment is generally shorter than the length of the planar portion of the front face, and is preferably 2½" or less. One of the side faces of the masonry building unit is angled (e.g.— includes at least an angled segment) and intersects the second segment of the front face and also intersects the back face. This face forms an obtuse angle with the back face. This face can form a right angle, an acute or an obtuse angle with the second segment of the front face. It is also preferred according to the present invention that a return edge or lip of a minor portion of the angled side wall that intersects the front face is also glazed. The angled return portions of the glazed masonry units face each other.

The reference to the location of the faces of the unit such as front, back, top, bottom and side is used herein to denote the relationship of the various faces to each other but is not intended to denote the orientation of the unit in a particular building construction. In addition, the various angles of the finished intersecting faces can be sharply defined as illustrated in various figures or can be somewhat rounded. When rounded it is typically rounded with a radius of about ½ inch to about 3 inches, and more typically about 1 inch.

A further aspect of the present invention is concerned with a mold that is suitable for the fabrication of glazed masonry building units. In particular, the mold includes a bottom portion having a horizontal planar segment and an angled segment that intersects the horizontal planar segment at an angle. The mold also includes sidewalls and a back flange. The flange is located at the end of the mold farthest from the angled segment.

A still further aspect of the present invention is concerned with a method for fabricating a glazed masonry unit. The method includes applying a glaze composition to the horizontal planar bottom inner surface of the mold described hereinabove. A shaped masonry unit is then placed in the mold. The masonry unit has a front face that includes a planar portion and an angled segment that generally corresponds to the horizontal planar segment and angled segment of the mold. Glaze composition is also added in the cavity formed between the masonry unit and mold along the inside of the angled segment of the mold. The glaze composition is then cured. The glazed masonry unit is removed from the mold by inverting or turning the mold with the block therein over and then by applying pressure to the flange of the mold, the mold is lifted off from the glazed masonry unit. It is essential that the pressure is applied to the flange at the back end for release of those masonry units having a negative return such as the glazed lip portion.

In an alternative embodiment there is provided a masonry building unit for use in constructing a structurally reinforced corner. The masonry building unit includes a front face, a back face, a top face, a bottom face and two side faces. The front face, which is intended to be exposed as part of the main wall unit, includes a planar surface that is opposite the back face and preferably extends parallel to the back face and a second angled surface that intersects the planar portion at a right, obtuse or acute angle. The length of the second segment is generally shorter than the length of the planar portion of the front face, and is preferably 2½ inches or less. One of the side faces of the masonry building unit is angled (e.g.—includes at least an angled segment) and intersects the second segment of the front face and also intersects the back face. This face forms an obtuse angle with the back face. This side face can form a right angle, an acute or an obtuse angle with the second segment of the front face. In addition, interposed between the front face and back face, there is a cut out portion in the side face. The cut out portion makes it possible to reinforce the corner at the junction of the unit with another masonry unit by providing space for pouring concrete or by providing the space for the insertion of a reinforcing member segment of an adjoining masonry unit.

In a further embodiment according to the present invention, a system is provided that utilizes a composite or construction for constructing a corner that contains one of the glazed angled masonry units and a glazed stretcher block that is mitred to complement the angled side face of the glazed masonry unit.

In a still further aspect of the present invention, there is provided a composite for turning a corner including providing a column or portion thereof that employs at least two glazed angled concrete block masonry building units of the types disclosed hereinabove. The glazed angled concrete block masonry units are oriented such that the angled side face of one glazed angled masonry building unit is opposed the opposite side face of a second glazed angled concrete block masonry unit.

SUMMARY OF DRAWINGS

FIG. 1 is an isometric view of a glazed masonry unit pursuant to the present invention.

FIG. 2 is an isometric view of a mold suitable for obtaining the glazed masonry unit pursuant to the present invention.

BEST AND VARIOUS MODES FOR CARRYING OUT INVENTION

Figure 3:
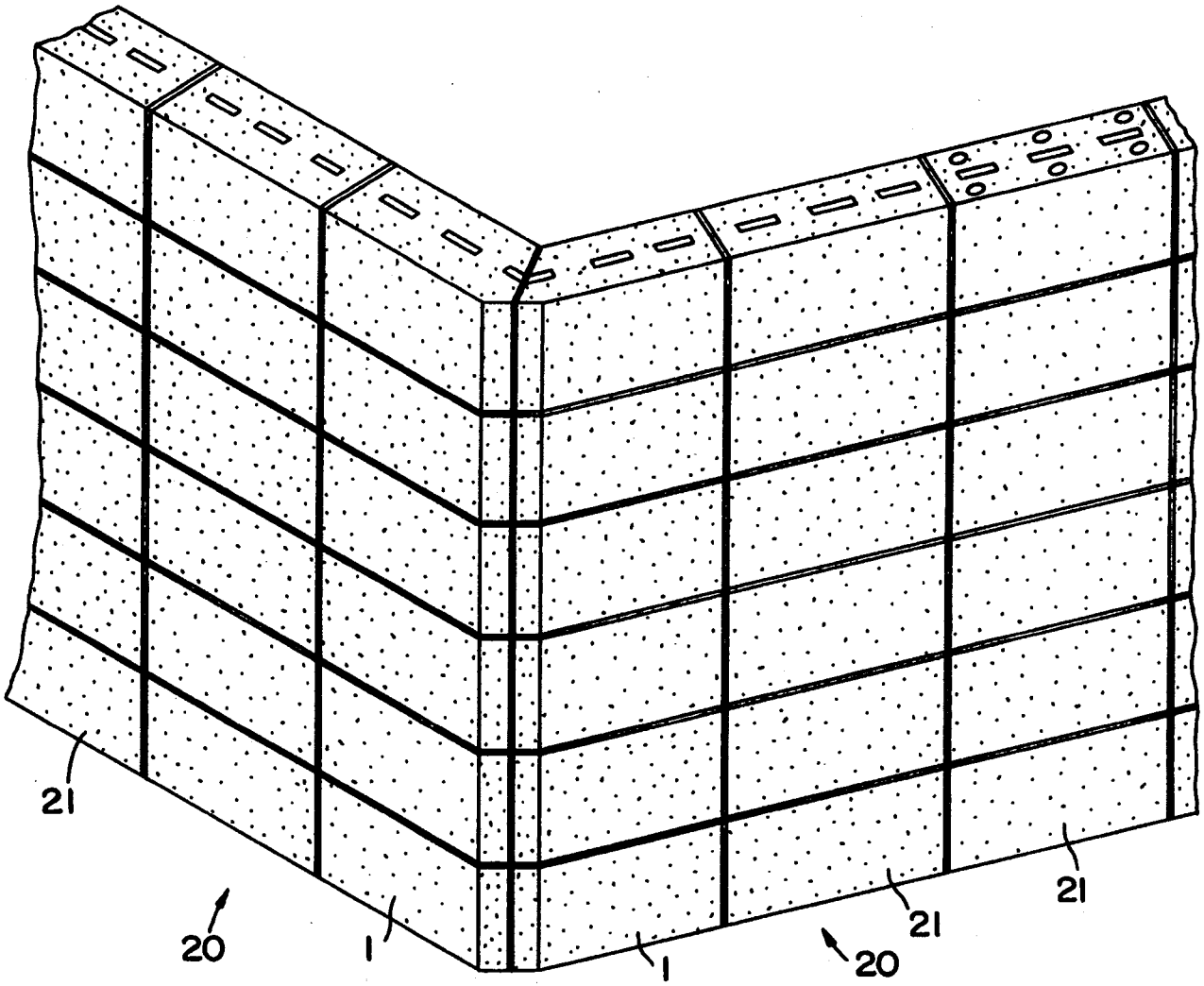
FIG. 3 is an isometric view of a section of a wall pursuant to the present invention.
Figure 4:
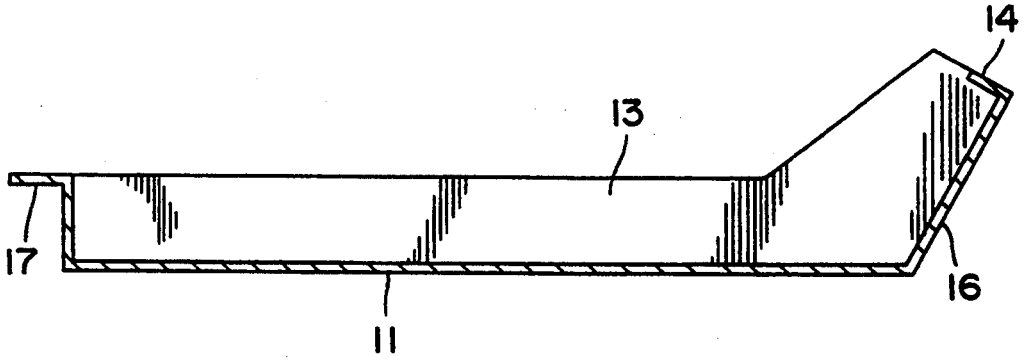
FIG. 4 is a side view of the mold of FIG. 2.
Figure 5:
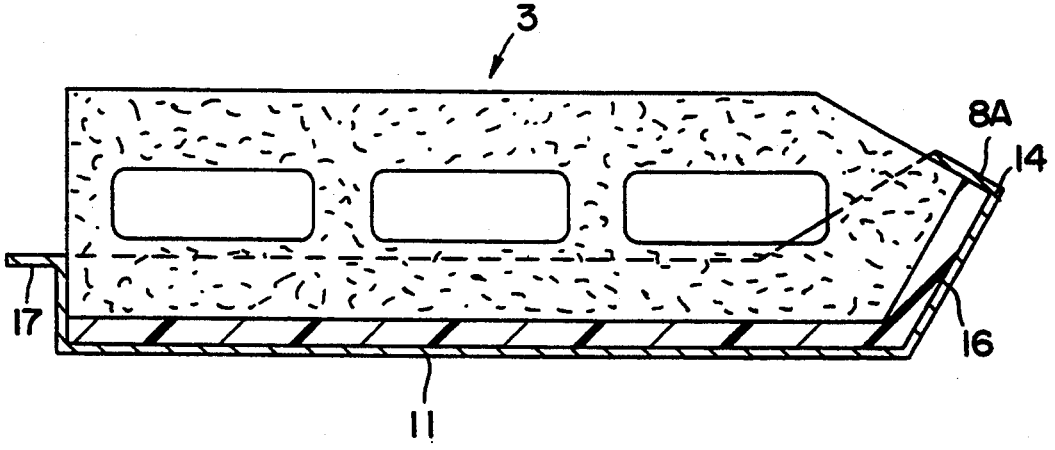
FIG. 5 is a side view of the mold containing the glazing composition and a masonry unit.

In order to facilitate an understanding of the present invention, reference is made to the figures. In particular, FIG. 1 is an isometric view of a glazed masonry unit pursuant to the present invention that includes a glaze 2 on the front face 3 of the masonry block 1. Examples of suitable glaze compositions are based upon the unsaturated polyester resin compositions disclosed in U.S. Pat. Nos. 2,751,775, 3,328,231, 3,632,725, 4,031,289, and 4,329,822, the entire disclosures of which are hereby incorporated by reference and relied upon. The masonry block 1 can be made from those materials employed to produce masonry block such as cinders, slag, cement, haydite, clay, or the like. This glazed front face of the masonry block is that face which is intended to be exposed to the environment in which the block is employed in a building application. The front face of the masonry block includes a planar portion 4 that is opposite to and preferably extends parallel to a back face 5. The front face also includes a second segment 6 that intersects the planar portion 4 at an obtuse, acute or right angle A depending upon the angle of the desired corner. In a preferred aspect according to the present invention, angle A is obtuse and most preferably about 135°.

In addition, it is essential in achieving the desired results obtained by the present invention that the second segment of the front face or return be shorter than the planar portion of the front face and preferably have a length that is about 75% or less of the planar portion of the front face, more preferably about 5% to about 50% of the planar portion of the front face and most preferably about 5% to 25% of the planar portion of the front face. Preferably, the second segment or return 6 is 2½" or less and usually at least about ½" and most preferably about 1" to about 2".

The reduction in unacceptable coatings such as ones having holes and/or color differences or formation of lines at the corner is quite significant when employing a shallow return 6, about 2½" or less pursuant to the preferred aspects of the present invention.

Figure 7:
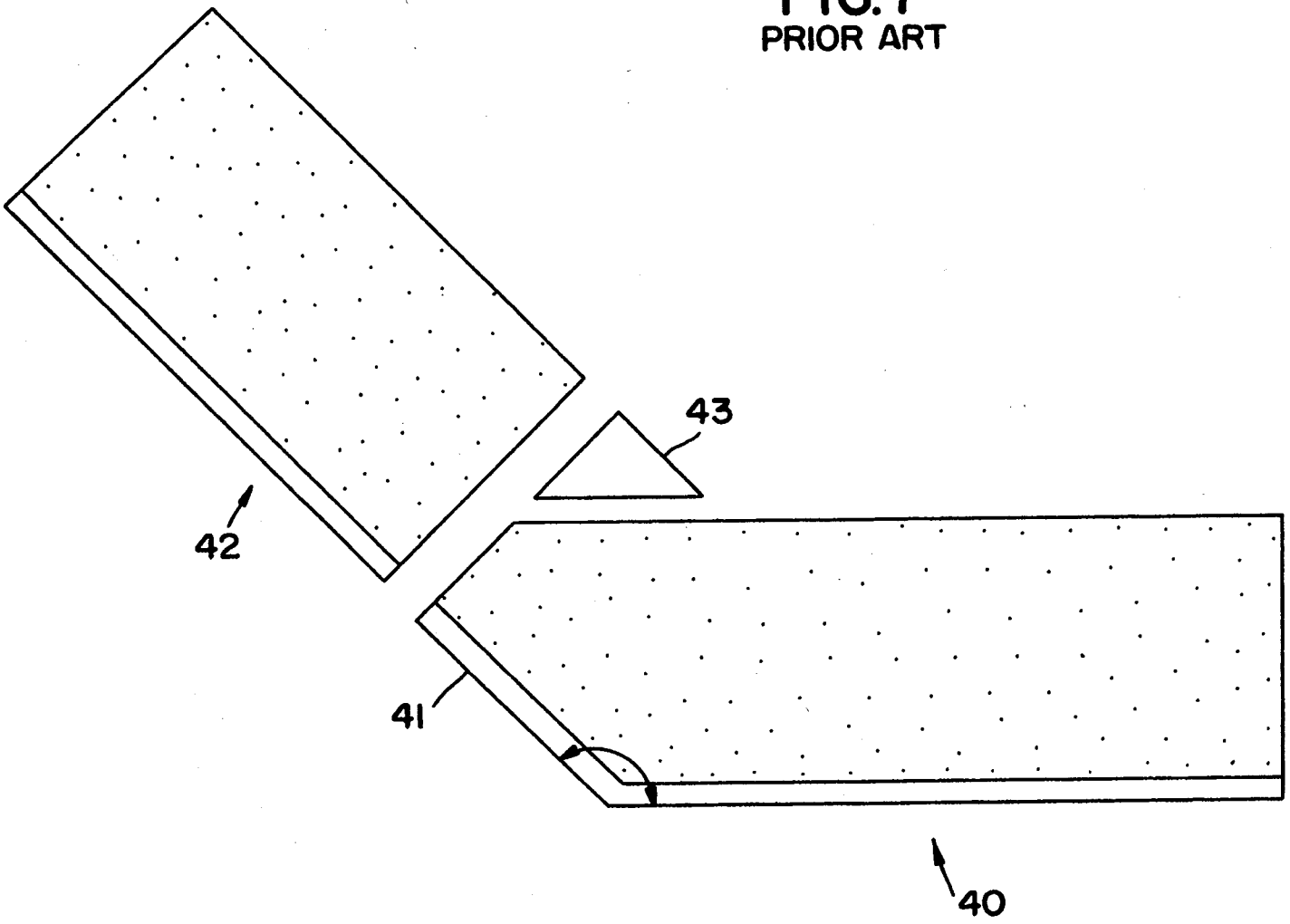
FIG. 7 PRIOR ART
FIG. 7 is a side view of a prior art corner turn.
Figure 7A:
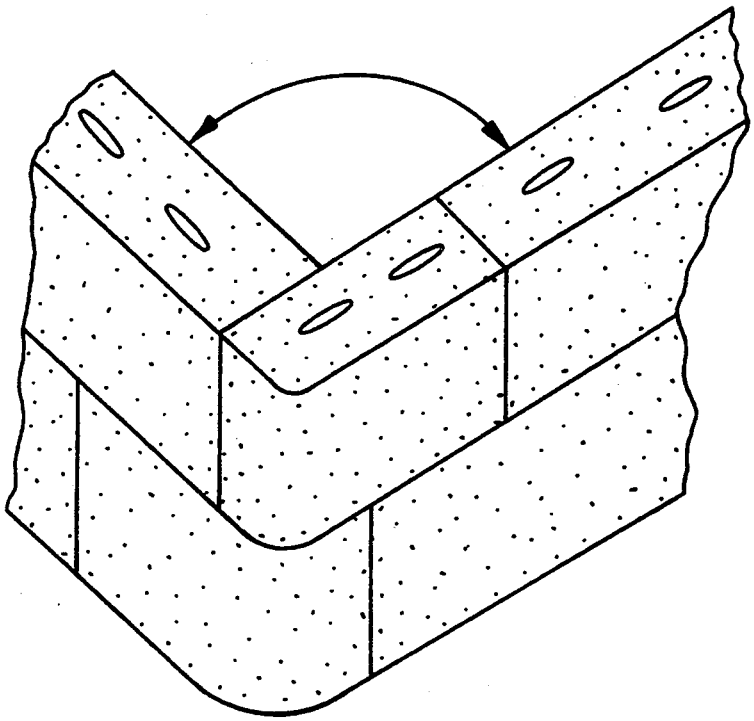
FIG. 7A PRIOR ART
FIG. 7A is an isometric view of another prior art corner turn.

Contrary to employing a shallow return, the prior art exemplified in FIG. 7 and 7A employed a relatively deep return 41 of at least about 3¾". Moreover, these prior art angled glazed blocks have been used only for turning a corner, and not for creating a high quality corner design such as a 90° turn as achieved by the present invention. Although such angled blocks have been in use for at least 15 years, such have merely been used as a single unit to turn the corner as contrasted to using two angled units together according to the present invention. The angled prior art unit 40 has been used in conjunction with a straight wall unit 42 and typically, but not necessarily, a fill 43. More typical of prior art is FIG. 7A which has a 90° angle and a 4", 6" or 8" depth.

Moreover, with the standard concrete blocks, employing a 2½" or less return, the wall thickness at the intersection of the two units is sufficiently thick to provide a stable corner, particularly when using a wall tie. On the other hand, as the return portion increases above this level, the wall thickness at the intersection decreases to the extent that it tends to become destabilized.

Figure 6:
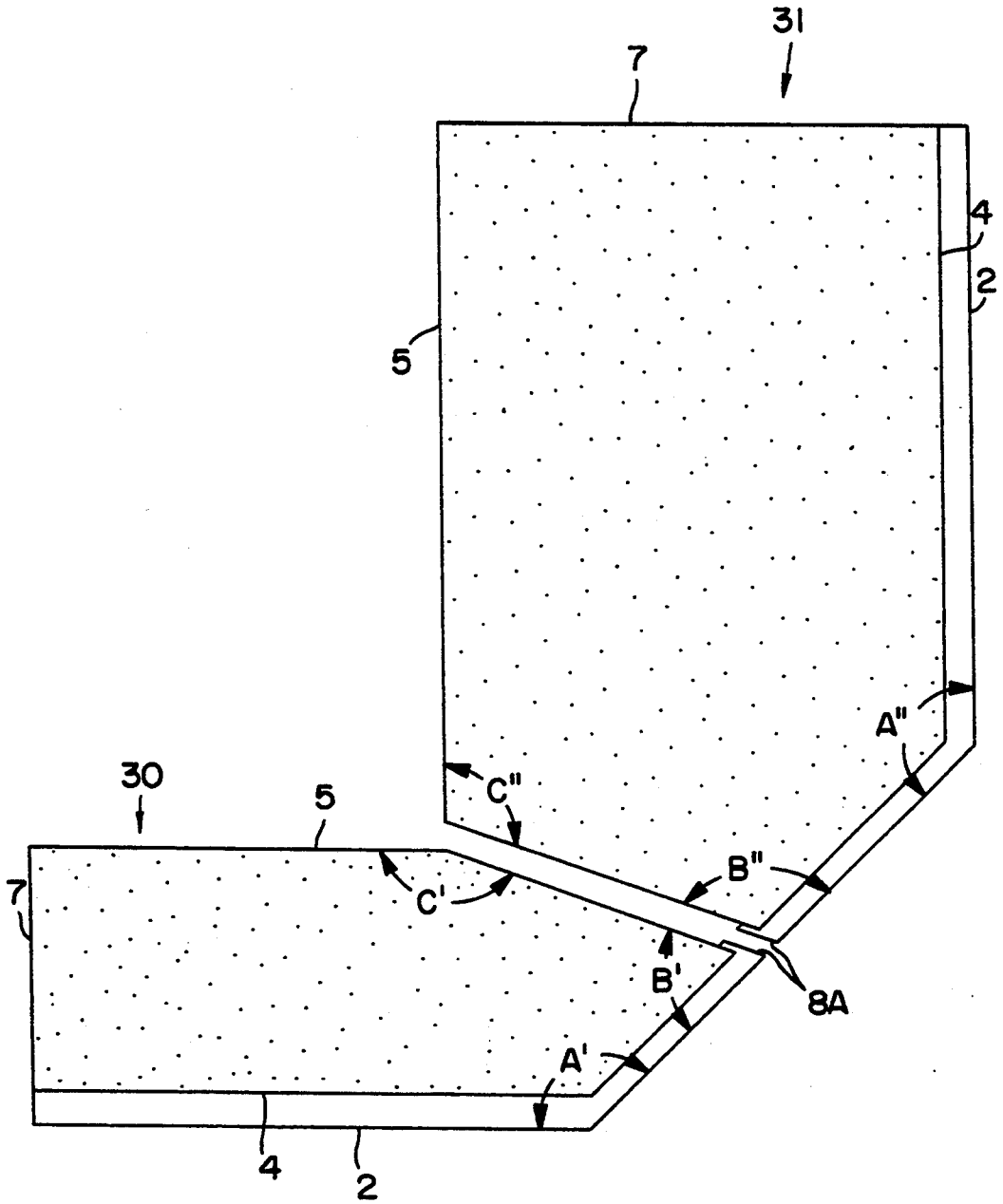
FIG. 6 is a top elevational view of two adjoining angled masonry unit that are of different thicknesses.

Side face 8 is angled and intersects the back face 5 and second segment 6 of the front face 3. Side face 8 forms an obtuse angle C with the back face 5, and in a preferred aspect of the present invention, angle C is about 135°. In addition, side face 8 forms an angle B with the second segment 6 which can be a right angle, an acute angle or an obtuse angle depending upon the intended use of the block. In the most preferred aspects of the present invention, angle B is about 90°. However, it may be acute or obtuse depending upon its intended use. For instance, when two angled blocks of the present invention of different thicknesses are to be used adjacent each other to turn a corner, angle B of one block will be acute or obtuse depending upon the relative thicknesses of the blocks. For example, see FIG. 6 where a nominal 4" block 30 is used with a nominal 8" block 31. The sum of angles A' and A" will be about 270° regardless of the relative thicknesses of block 30 and block 31. The sum of angles B' and B" will be about 180° regardless of the relative thicknesses of blocks 30 and 31. The sum of angles C' and C" will be about 270°.

Figure 8:
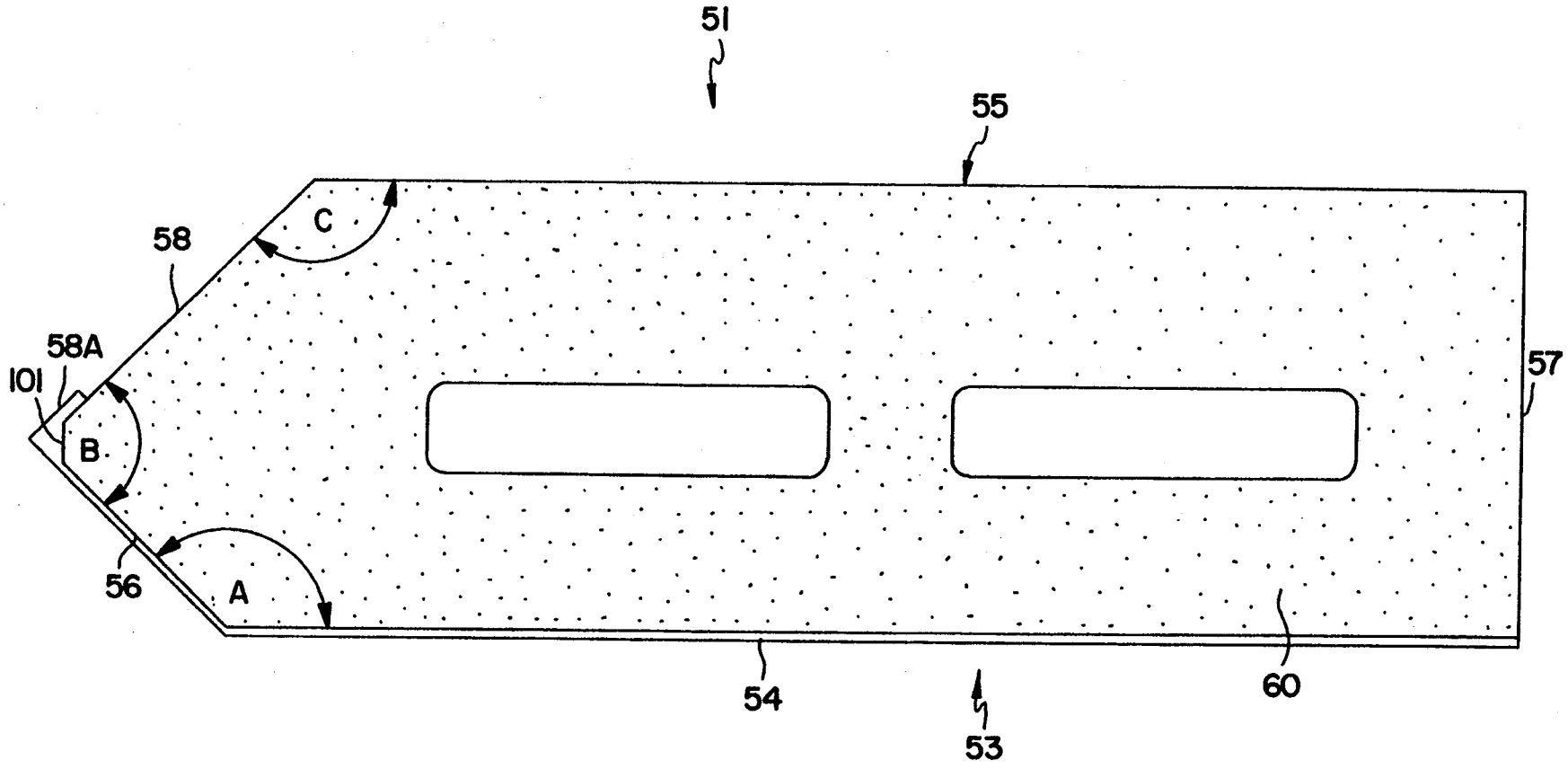
FIG. 8 is a top elevational view of a glazed masonry block pursuant to the present invention for creating a four inch corner.

In addition, it is further understood that the intersection of faces of the block need not be sharp or well defined corners but, if desired can be rounded off or truncated such as shown in FIG. 8 at 101.

According to preferred aspects of the present invention, a return edge or lip of a minor portion 8A of angled side wall 8 that intersects the second segment of the front face is also glazed. Typically this glazed portion 8A is about ⅛ inch to about 1 inch regardless of the length of side wall 8. The glazed portion 8A provides for a more finished look to the corner since there is a molded corner at the point of intersecting sides 6 and 8 and also provides for a joint that is less susceptible to chipping.

In addition, in a preferred aspect of the present invention, a minor portion 10A of top face 10 (see FIG. 1) is also glazed with the glazing composition. Typically this glazed portion 10A is about ½ inch to about 1 inch regardless of the width of the top face. The bottom face (not shown) is opposite the top face and preferably parallel to the top face as in conventional masonry units.

The length of the second segment (return) 6 is shorter than that of the side face 7 and is preferably about 75% or less of the length of the side face 7 and more preferably about 5% to about 50% of the side face 7, and most preferably about 5% to about 25% of the side face 7.

Reference to FIG. 3 shows a wall 20 including mating pairs of coated masonry blocks 1 of the present invention along with standard blocks 21. As noted, the joint between the mating blocks is not at the corner but rather on the flat portion after the turn. FIG. 2 illustrates a mold that can be employed for glazing the masonry blocks pursuant to the present invention. In particular, the mold includes a pan or a bottom portion 11, sidewalls 12, enlarged angled sidewall portion 13 and a lip portion 14 at the head end 16 of the bottom portion. The enlarged angled sidewall portion 13 is not required but instead is preferred to provide added strength to the mold to prevent bending during the release of the finished product. The enlarged portion also helps to prevent leakage of the coating during the glazing.

Bottom portion 11 includes a horizontal planar segment 15 and an angled segment 16 that intersects segment 15 at an angle (e.g.—135°) corresponding to the angle A of the masonry block to be glazed.

In addition, the lip portion 14 is not required but instead is employed pursuant to preferred embodiment of the present invention to provide for glazing a corresponding portion of the masonry block. This provides for a more finished look to the corner employing the block as well as providing a joint that is less susceptible to chipping.

Moreover, the mold contains a back flange 17. The back flange 17 provides a location where pressure can be applied to the mold for removal of the glazed block upon completion of the processing. Holes 18 in back flange 17 are merely to provide means for hanging the mold for pretreatment such as coating with an enamel, or plating with a metal such as nickel or chrome. The flange typically extends out from the mold from about ¼" to about 1½" and more typically about 1". For ease of manufacture, the flange is typically the same width as is the mold but can be less or more if desired.

The mold employed as apparent to those skilled in the art will be somewhat larger than the block to be glazed in order to accommodate the glaze composition. For a mold to coat a block having an eight (8) inch high nominal front face, the width of the mold will be about 7¾ inches, the side walls will be about ½ inch to about 1 inch, the angle wall portion, when employed will rise at an angle of about 135° to a height of about 0.75 inch to about 3.75 inches or even up to 7¾ inches. The side walls are substantially perpendicular to the bottom portion and typically at about a 93° angle. The lip portion when employed being about ⅛" to about 1" and more typically about ⅜" to about ½.

In use, the desired glaze composition is applied to the horizontal portion 15 of the mold to the desired thickness less than the height of the walls 12. Typical glaze thicknesses on face 6 are about ⅛" to about ¾" and on face 2 are about ⅛" to about ¾". Also typical compositions are in the form of relatively viscous slurries having a ratio of filler to liquid of about 2.5:1 to about 7:1 and more typically about 4.0:1 to about 4.5:1. The glaze composition can be uniformly distributed over the horizontal bottom surface of the mold by employing a mechanical device such as a shaker and vibrator as known in the art. Next the shaped block is placed in the mold. The block can either be premolded to the desired shape or can be cut from a standard rectangular shaped block.

According to preferred aspects of the present invention, aggregate, typically sand, is then placed around the edges of the block between the inside of sidewalls 12 and the block, and filled to the top of mold. The aggregate typically has a particle size of about 30 to about 150 mesh. The aggregate is wetted by a wicking action from the slurry and facilitates glazing of the block.

After this, putty such as that commercially available, clay, or more commonly modelling clay, can be securely placed between the block and the edge of the mold along the sidewall of the angled portion of the mold. However, the clay or putty is not necessary. The glazing composition is then poured into the cavity remaining between the block and mold along the inside of the angled portion of the mold for glazing of the angled segment of the block. The lip provides for glazing of the corresponding portion of the block. The putty or clay helps in conjunction with the block to maintain the slurry in place for glazing of the block, while filling and going through the cure cycle.

After this, the glazing composition is cured. The curing can be carried out at room temperature, if desired, depending upon the specific composition selected. Preferably, it is carried out at an elevated temperature of about 150° F. to about 450° F. and more preferably at about 280° F. to about 320° F. Typically, the temperature of the coating is raised to these levels in about 10–30 minutes and held there for sufficient time such as 2–5 minutes to complete polymerization.

An advantage of the present invention is that the entire glazing can be cured in less time as compared to glazing two adjacent sides of a standard shaped masonry unit. The curing can be accomplished in the curing cycle presently used to cure polyester glazing compositions on stretcher masonry units.

After the glaze is properly cured, the glazed masonry unit is removed from the mold by turning the mold with the unit therein over and by applying pressure at the flange of the mold to thereby lift off the mold and release the glazed product.

The present invention releases the product from the back end of the mold as contrasted to prior art techniques that release the product from the head end of the mold. By this technique of the present invention, the shaped articles that have a negative return can be produced, which was not possible from prior art technique. As can be appreciated from the above disclosure, the present invention makes it possible to provide corner masonry units that do not require further trimming as experienced with other corner masonry units on the market. All of the needed trimming can be carried out prior to the glazing or coating. The unique concept of stripping the mold in an opposite way from the traditional techniques enable the mold to incorporate a lip in the reverse edge, which actually forms a mold edge which otherwise would have had to been a cut edge lacking the benefits of appearance and uniformity of a premolded edge. Also, the present invention provides for a relatively fast, easy and efficient manner for providing glazed corner masonry units. This in turn results in being able to comply with requests for the corner units in a timely manner.

More particularly, the present invention and, especially the preferred aspects of employing a narrow return, make it possible to provide a corner system employing glazed masonry units that are formed in a manufacturing manner similar to that employed in making a straight wall unit or stretcher. This provides the ease and quality available through stretcher manufacturing techniques as well as the high production speed available using the stretcher manufacturing methods, and also eliminates the traditional problems of pinholes, voids and sand drop out, swirling and color variation associated with deep molded returns on cornering units. The new corner unit that is the subject of the present invention also accelerates the speed and quantity of output possible because the lack of deep molding of a return reduces the cure time needed in a high temperature reaction system by 10% to 33%. Using current molding techniques for a polyester type glazed unit the time for cure will be reduced from about 18 minutes per unit to 12 minutes per unit. The lack of a thick deep molded return will also reduce the risk of extreme thermal shock and stress generated by the catalyzation and heat of cross-linking generated by a thick or deep corner return in either a room temperature or heat accelerated exotherm as the polymer is converted from a liquid to a solid.

Moreover, the present corner masonry units are especially cost efficient as compared to structures used in the prior art.

FIG. 8 is a top elevational view of a glazed masonry block used in forming a four inch corner pursuant to the present invention that includes a glaze 52 on the front face 53 of the masonry block 51. This glazed front face 53 of the masonry block 51 is that face which is intended to be exposed to the environment in which the block is employed in a building application. The front face of the masonry block includes a planar portion 54 that is opposite to and preferably extends parallel to a back face 55. The front face also includes a second segment 56 that intersects the planar portion 54 at an obtuse, acute or right angle A depending upon the angle of the desired corner. In a preferred aspect according to the present invention, angle A is obtuse and most preferably about 135°.

In addition, it is essential in achieving the desired results obtained by the present invention that the second segment of the front face or return 56 be shorter than the planar portion 54 of the front face and preferably have a length that is about 75% or less of the planar portion of the front face, more preferably about 5% to about 50% of the planar portion of the front face and most preferably about 5% to 25% of the planar portion of the front face. Preferably, the second segment or return 56 is 2½ inches or less and usually at least about ½" and most preferably about 1" to about 2". In this embodiment the second segment is about 1.75 inches. The planar portion 54 of the front face is about 12.50 inches.

The reduction in unacceptable coatings such as ones having holes and/or color differences or formation of lines at the corner is quite significant when employing a shallow return 56, about 2½ inches or less pursuant to the preferred aspects of the present invention.

Side face 58 is angled and intersects the back face 55 and second segment 56 of the front face 53. Side face 58 forms an obtuse angle C with the back face 55, and in preferred aspect of the present invention, angle C is about 135°. In addition, side face 58 forms an angle B with the second segment 56 which can be a right angle, an acute angle or an obtuse angle depending upon the intended use of the block. In the most preferred aspects of the present invention, angle B is about 90°. However, it may be acute or obtuse depending upon its intended use. In this embodiment side face 58 is about 2.75 inches long and back face 55 is about 11.625 inches long. The intersection between side face 58 and the second segment 56 is truncated as shown by segment 101 which in this embodiment is about 0.25 inches. Typically such truncation is about ⅛ inch to about 1 inch. The truncated portion facilitates the flow of the glaze composition and thereby the glazing process in that region. However, as should be apparent from this disclosure, it is not essential, but merely desirable, that a truncated portion be employed. The glaze, however, as shown in FIG. 8, does not result in a truncated profile. Instead it results in a profile that extends outwardly from the truncated portion.

According to preferred aspects of the present invention, a return edge or lip of a minor portion 58A of angled side wall 58 that intersects the second segment of the front face is also glazed. Typically this glazed portion 58A is about ⅛ inch to about 1 inch. The glazed portion 58A provides for a more finished look to the corner since there is a molded corner at the location of intersecting sides 56 and 58 and also provides for a joint that is less susceptible to chipping.

In addition, in a preferred aspect of the present invention, a minor portion (not shown) of top face 60 is also glazed with the glazing composition. Typically this glazed portion is about ½ inch to about 1 inch. The bottom face (not shown) is opposite the top face 60 and preferably parallel to the top face as in conventional masonry units.

The length of the second segment (return) 56 is shorter than that of the side face 57 and is preferably about 75% or less of the length of the side face 57 and more preferably about 5% to about 50% of the side face 57, and most preferably about 5% to about 25% of the side face 57. In this embodiment, side face 57 (unglazed) is about 3.625 inches long and about 3.75 inches long with the glaze. Side face 56 is typically about 1.875 inches long.

Figure 9:
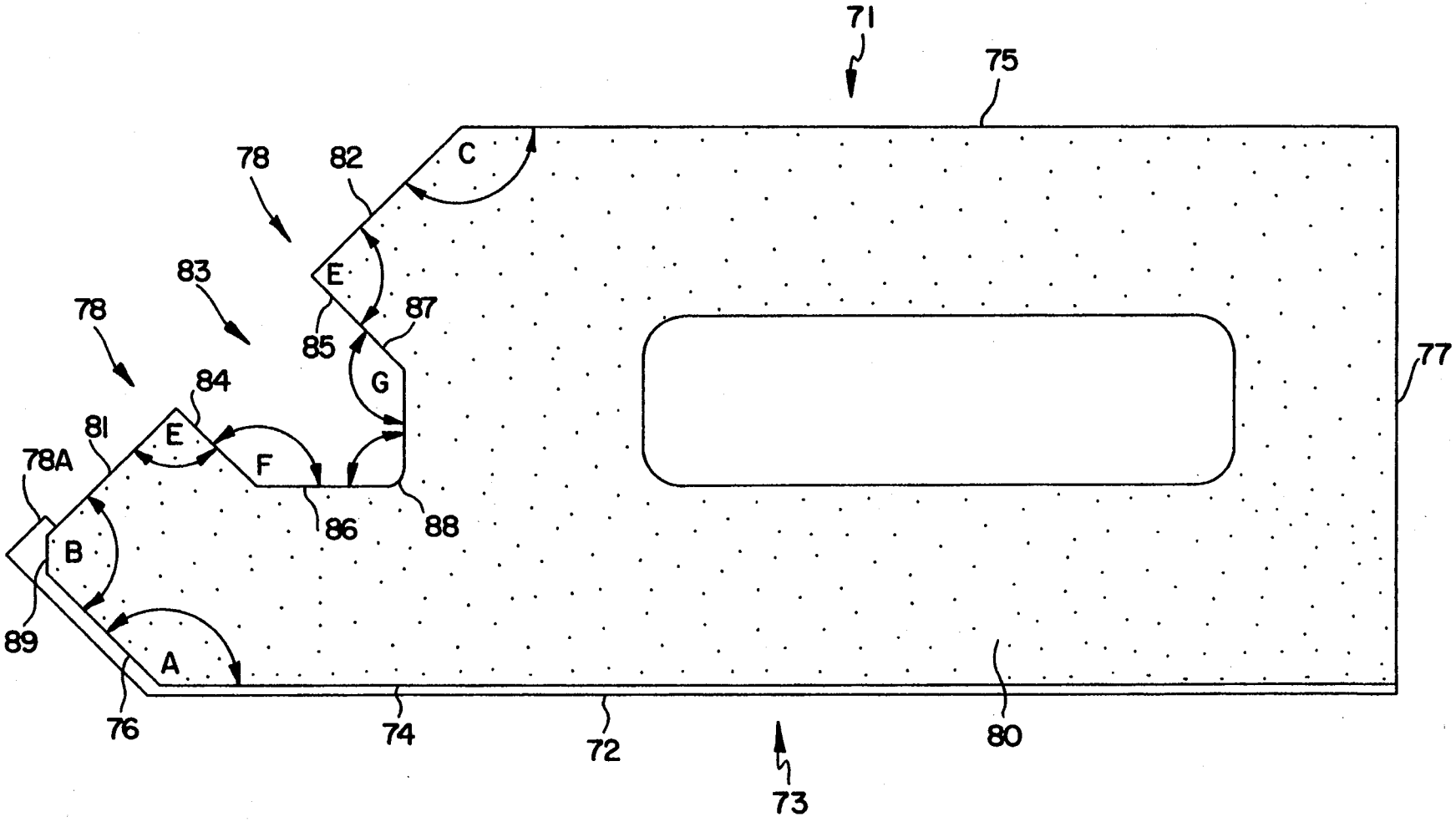
FIGS. 9–11 are top elevational views of masonry units having a cut out portion in a side wall pursuant to an alternative embodiment of the present invention.
Figure 10:
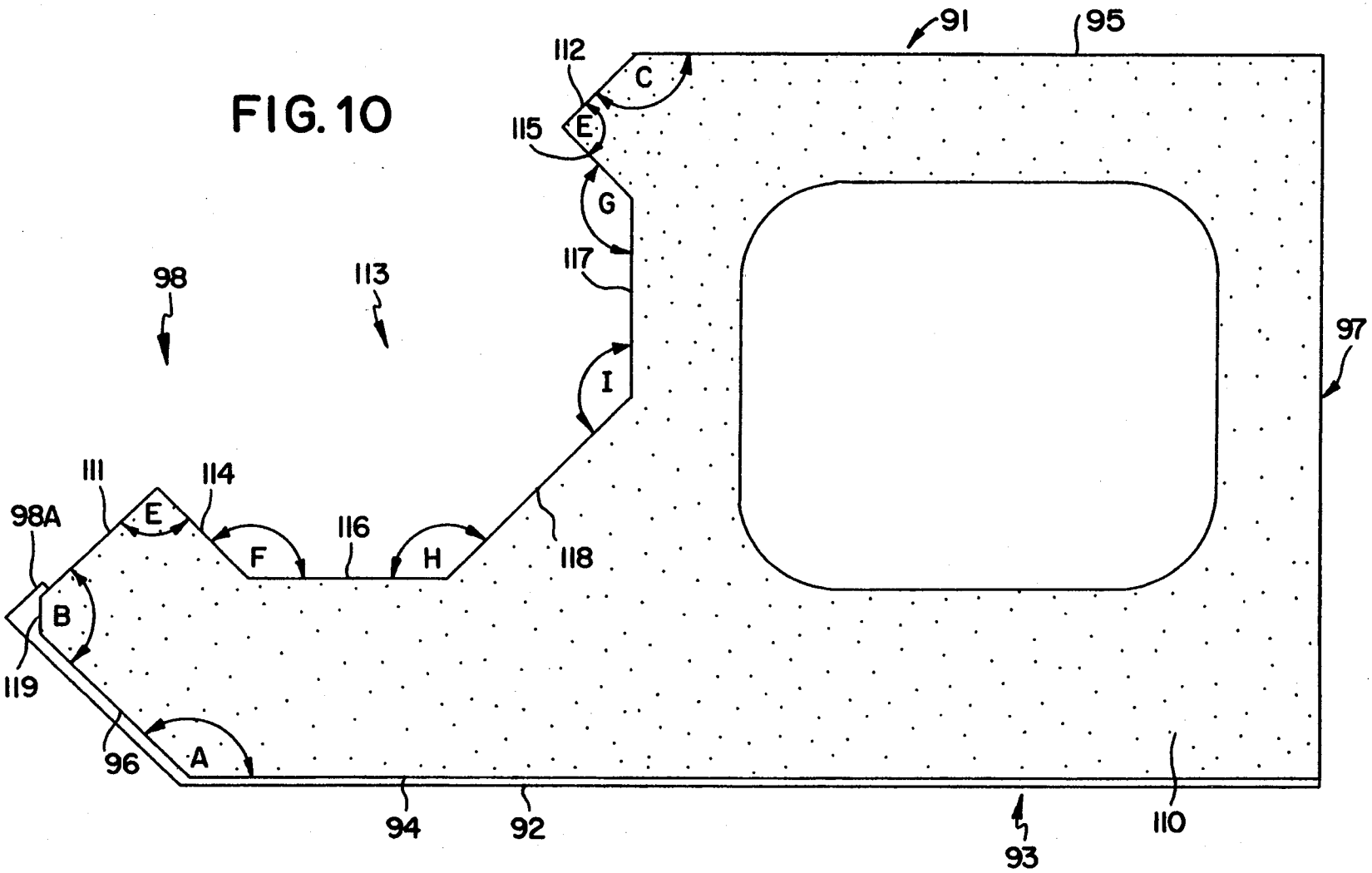
Figure 11:
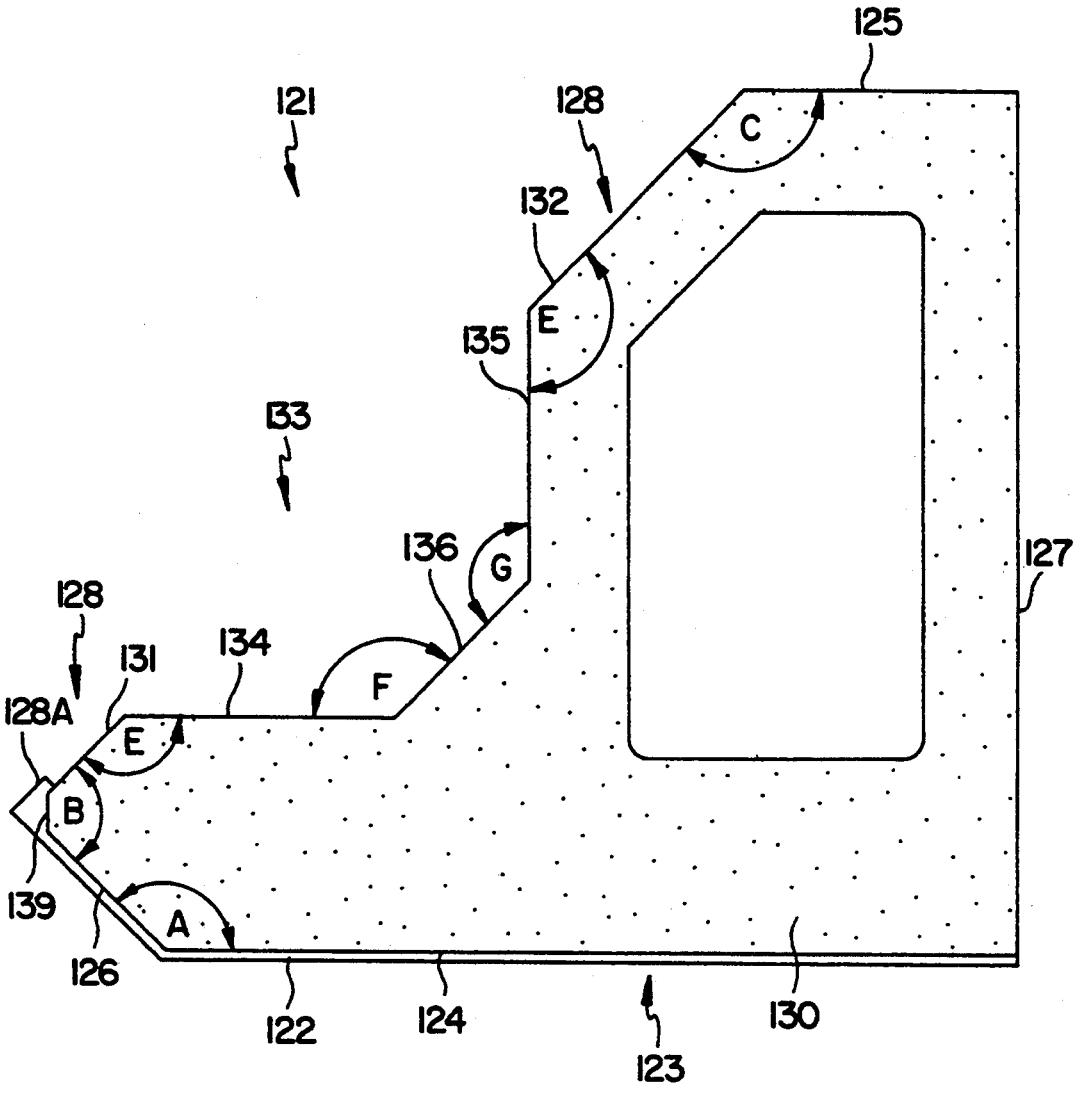

FIGS. 9, 10 and 11 are top elevational views of masonry units having a cut out portion in a side wall. The cut out portion provides for structural reinforcement of a corner fabricated using such unit. The reinforcement can be provided by pouring cement into the recess created by the cut out portion, and if desired, reinforcing rods or other such structure can also be provided in the recess. In an alternative embodiment, a masonry unit having a protuberance portion that mates with the cut out portion in the side wall can be used to provide for the enhanced reinforcement. For instance, see FIG. 12.

The cut out portion merely needs to be large enough to provide the desired additional strength with the maximum size being primarily limited by merely assuring the integrity of the block during handling and construction and by economics. In addition, the location of the cut out portion is typically such that the length of the side wall adjacent to each end of the cut out portion is at least about 1½ inches and preferably at least about 1.625 inches to insure against a portion of the block breaking off during handling and construction. The specific dimensions for the cut out portion and location for a particular embodiment can be determined by those skilled in the art once aware of this disclosure without undue experimentation.

FIG. 9 is a top elevational view of a 6 inch corner masonry unit pursuant to the present invention that includes a glaze 72 on the front face 73 of the masonry block 71.

As discussed above, this embodiment of the present invention can be provided in the form of an unglazed or raw block as well as a glazed block shown in this figure. The front face of the masonry block includes a planar portion 74 that is opposite to and preferably extends parallel to a back face 75. The front face also includes a second segment 76 that intersects the planar portion 74 at an obtuse, acute or right angle A depending upon the angle of the desired corner. In a preferred aspect according to the present invention, angle A is obtuse and most preferably about 135°.

In addition, it is essential in achieving the desired results obtained by the present invention that the second segment of the front face or return 76 be shorter than the planar portion 74 of the front face and preferably have a length that is about 75% or less of the planar portion of the front face, more preferably about 5% to about 50% of the planar portion of the front face and most preferably about 5% to 25% of the planar portion of the front face. Preferably, the second segment or return 76 is 2½" or less and usually at least about ½" and most preferably about 1" to about 2". In this embodiment, the second segment is about 1.875 inches. The planar portion 54 of the front face is about 12.50 inches.

Side face 78 is angled and intersects the back face 75 and second segment 76 of the front face 73. Side face 78 forms an obtuse angle C with the back face 75, and in preferred aspect of the present invention, angle C is about 135°. In addition, side face 78 forms an angle B with the second segment 76 which can be a right angle, an acute angle or an obtuse angle depending upon the intended use of the block. In the most preferred aspects of the present invention, angle B is about 90°. However, it may be acute or obtuse depending upon its intended use.

Side face 78 includes segments 81 and 82 with cut out portion 83 located therebetween. In this embodiment segment 81 is about 1.625 inches long, segment 82 is about 1.875 inches long and cut out portion 83 is about 2.31 inches wide. Cut out portion 83 includes opposing side walls 84 and 85 which in this embodiment are about 1.1875 inches long. Side walls 84 and 85 intersect segments 81 and 82, respectively, at an angle E which is preferably but not necessarily a 90° angle. Also side walls 84 and 85 intersect side walls 86 and 87, respectively at angles F and G, respectively. Angles F and G in this embodiment are each about 135°. Walls 86 and 87 converge forming a rounded portion 88.

The intersection between side face 78 and the second segment 76 of the raw block only is truncated as shown by segment 89, which in this embodiment is about 0.25 inches.

According to preferred aspects of the present invention, a return edge or lip of a minor portion 78A of angled side wall 78 that intersects the second segment of the front face is also glazed. Typically this glazed portion 78A is about ⅛ inch to about 1 inch. The glazed portion 78A provides for a more finished look to the corner since there is a molded corner at the point of intersecting sides 76 and 78 and also provides for a joint that is less susceptible to chipping.

In addition, in a preferred aspect of the present invention, a minor portion (not shown) of top face 80 (see FIG. 1) is also glazed with the glazing composition. Typically this glazed portion is about ½ inch to about 1 inch regardless of the width of the top face. The bottom face (not shown) is opposite the top face 80 and preferably parallel to the top face as in conventional masonry units.

The length of the second segment (return) 76 is shorter than that of the side face 77 and is preferably about 75% or less of the length of the side face 77 and more preferably about 5% to about 50% of the side face 77, and most preferably about 5% to about 25% of the side face 77.

In this embodiment, side face 77 (unglazed) is about 5.625" long and about 5.75 inches along with the glaze, and back face 75 is about 9.75 inches long.

FIG. 10 is a top elevational view of an 8 inch corner masonry unit pursuant to the present invention that includes a glaze 92 on the front face 93 of the masonry block 91. As discussed above, this embodiment of the present invention can be provided in the form of an unglazed or raw block as well as a glazed block shown in this FIG. 10.

The front face of the masonry block includes a planar portion 94 that is opposite to and preferably extends parallel to a back face 95. The front face also includes a second segment 96 that intersects the planar portion 94 at an obtuse, acute or right angle A depending upon the angle of the desired corner. In a preferred aspect according to the present invention, angle A is obtuse and most preferably about 135°.

In addition, it is essential in achieving the desired results obtained by the present invention that the second segment of the front face or return 96 be shorter than the planar portion 94 of the front face and preferably have a length that is about 75% or less of the planar portion of the front face, more preferably about 5% to about 50% of the planar portion of the front face and most preferably about 5% to 25% of the planar portion of the front face. Preferably, the second segment or return 96 is 2½" or less and usually at least about ½" and most preferably about 1" to about 2" which is this embodiment is about 1.875 inches. The planar portion 94 of the front base is about 12.50 inches.

Side face 98 is angled and intersects the back face 95 and second segment 96 of the front face 93. Side face 98 forms an obtuse angle C with the back face 95, and in preferred aspect of the present invention, angle C is about 135°. In addition, side face 98 forms an angle B with the second segment 96 which can be a right angle, an acute angle or an obtuse angle depending upon the intended use of the block. In the most preferred aspects of the present invention, angle B is about 90°. However, it may be acute or obtuse depending upon its intended use.

Side face 98 includes segments 111 and 112 with cut out portion 113 located therebetween. In this embodiment segment 111 is about 1.625 inches long, segment 112 is about 1.875 inches long and cut out portion 113 is about 5.125 inches wide. Cut out portion 113 includes opposing side walls 114 and 115 which in this embodiment are about 1.0 inches long. Side walls 114 and 115 intersect segments 111 and 112, respectively, at an angle E which is preferably but not necessarily a 90° angle. Also side walls 114 and 115 intersect side walls 116 and 117, respectively at angles F and G, respectively. Angles F and G in this embodiment are each about 135°.

Walls 116 and 117 intersect bottom 118 of cut out portion at angles H and I, respectively, Angles H and I in this embodiment are each about 135°. In this embodiment, walls 116 and 117 are each about 2.0 inches, bottom 118 is about 2.50 inches wide. Cut out portion 113 is about 2.50 inches deep.

The intersection between side face 98 and the second segment 96 of the raw block only is truncated as shown by segment 119, which in this embodiment is about 0.25 inches.

According to preferred aspects of the present invention, a return edge or lip of a minor portion 98A of angled side wall 98 that intersects the second segment of the front face is also glazed. Typically this glazed portion 98A is about ⅛ inch to about 1 inch. The glazed portion 98A provides for a more finished look to the corner since there is a molded corner at the point of intersecting sides 96 and 98 and also provides for a joint that is less susceptible to chipping.

In addition, in a preferred aspect of the present invention, a minor portion (not shown) of top face 110 is also glazed with the glazing composition. Typically this glazed portion is about ½ inch to about 1 inch regardless of the width of the top face. The bottom face (not shown) is opposite the top face 110 and preferably parallel to the top face as in conventional masonry units.

The length of the second segment (return) 96 is shorter than that of the side face 97 and is preferably about 75% or less of the length of the side face 97 and more preferably about 5% to about 50% of the side face 97, and most preferably about 5% to about 25% of the side face 97.

In this embodiment, side face 97 (unglazed) is about 7.625" long and about 7.75 inches long with the glaze, and back face 95 is about 7.78" long.

FIG. 11 is a top elevational view of a 12 inch corner masonry unit pursuant to the present invention that includes a glaze composition 122 on the front face 123 of the masonry block 121. As discussed above, this embodiment of the present invention can be provided in the form of an unglazed or raw block as well as a glazed block shown in this FIG. 11.

The front face of the masonry block includes a planar portion 124 that is opposite to and preferably extends parallel to a back face 125. The front face also includes a second segment 126 that intersects the planar portion 124 at an obtuse, acute or right angle A depending upon the angle of the desired corner. In a preferred aspect according to the present invention, angle A is obtuse and most preferably about 135°.

In addition, it is essential in achieving the desired results obtained by the present invention that the second segment of the front face or return 126 be shorter than the planar portion 124 of the front face and preferably have a length that is about 75% or less of the planar portion of the front face, more preferably about 5% to about 50% of the planar portion of the front face and most preferably about 5% to 25% of the planar portion of the front face. Preferably, the second segment or return 126 is 2½" or less and usually at least about ½" and most preferably about 1" to about 2" which in this embodiment is about 1.875 inches. The planar portion 124 of the front face is about 12.50 inches.

Side face 128 is angled and intersects the back face 125 and second segment 126 of the front face 123. Side face 128 forms an obtuse angle C with the back face 125, and in preferred aspect of the present invention, angle C is about 135°. In addition, side face 128 forms an angle B with the second segment 126 which can be a right angle, an acute angle or an obtuse angle depending upon the intended use of the block. In the most preferred aspects of the present invention, angle B is about 90°. However, it may be acute or obtuse depending upon its intended use.

Side face 128 includes segments 131 and 132 with cut out portion 133 located therebetween. In this embodiment segment 131 is about 1.625 inches long, segment 132 is about 5.75 inches long and cut out portion 133 is about 6.875 inches wide. Cut out portion 133 includes opposing side walls 134 and 135 which in this embodiment are respectively about 3.625 inches long. Side walls 134 and 135 intersect segments 131 and 132, respectively, at an angle E which is preferably but not necessarily a 135° angle. Also side walls 134 and 135 intersect bottom portion 136 respectively at angles F and G, which in this embodiment are each about 135°. Bottom portion 136 is about 1.75 inches and the cut out portion is about 2.50 inches deep.

The intersection between side face 128 and the second segment 126 of the raw block only is truncated as shown by segment 139, which in this embodiment is about 0.25 inches.

According to preferred aspects of the present invention, a return edge or lip of a minor portion 128A of angled side wall 128 that intersects the second segment of the front face is also glazed. Typically this glazed portion 128A is about ⅛ inch to about 1 inch. The glazed portion 128A provides for a more finished look to the corner since there is a molded corner at the point of intersecting sides 126 and 128 and also provides for a joint that is less susceptible to chipping.

In addition, in a preferred aspect of the present invention, a minor portion (not shown) of top face 130 is also glazed with the glazing composition. Typically this glazed portion is about ½ inch to about 1 inch regardless of the width of the top face. The bottom face (not shown) is opposite the top face 130 and preferably parallel to the top face as in conventional masonry units.

The length of the second segment (return) 126 is shorter than that of the side face 127 and is preferably about 75% or less of the length of the side face 127 and more preferably about 5% to about 50% of the side face 127, and most preferably about 5% to about 25% of the side face 127.

In this embodiment, side face 127 (unglazed) is about 11.625" long and about 11.75 inches long with the glaze, and back face 125 is about 2.60 inches long.

Figure 12:
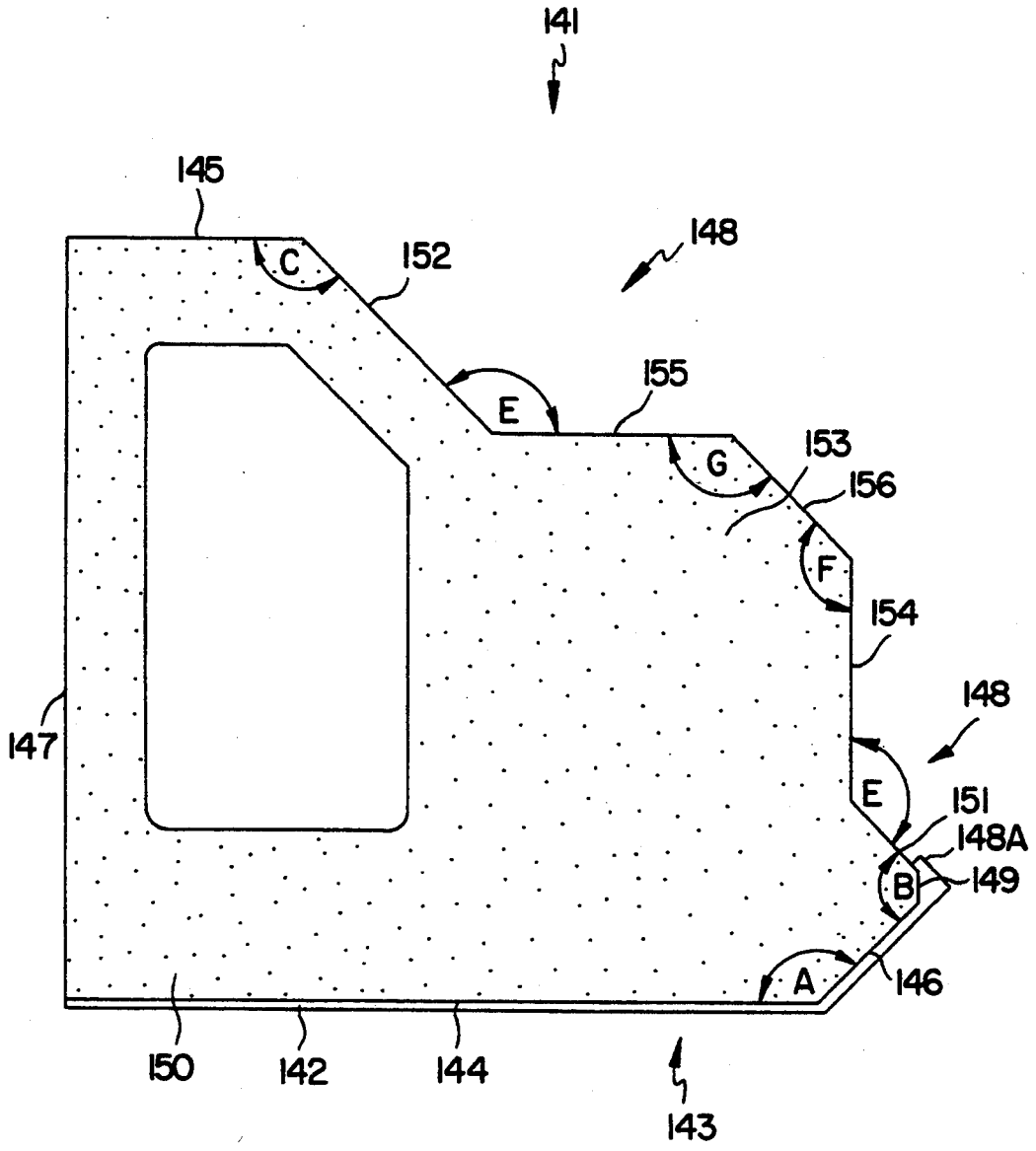
FIG. 12 is a top elevational view of a masonry unit having a protuberance portion that mates with the cut out portion in the side wall of FIG. 11.
Figure 13:
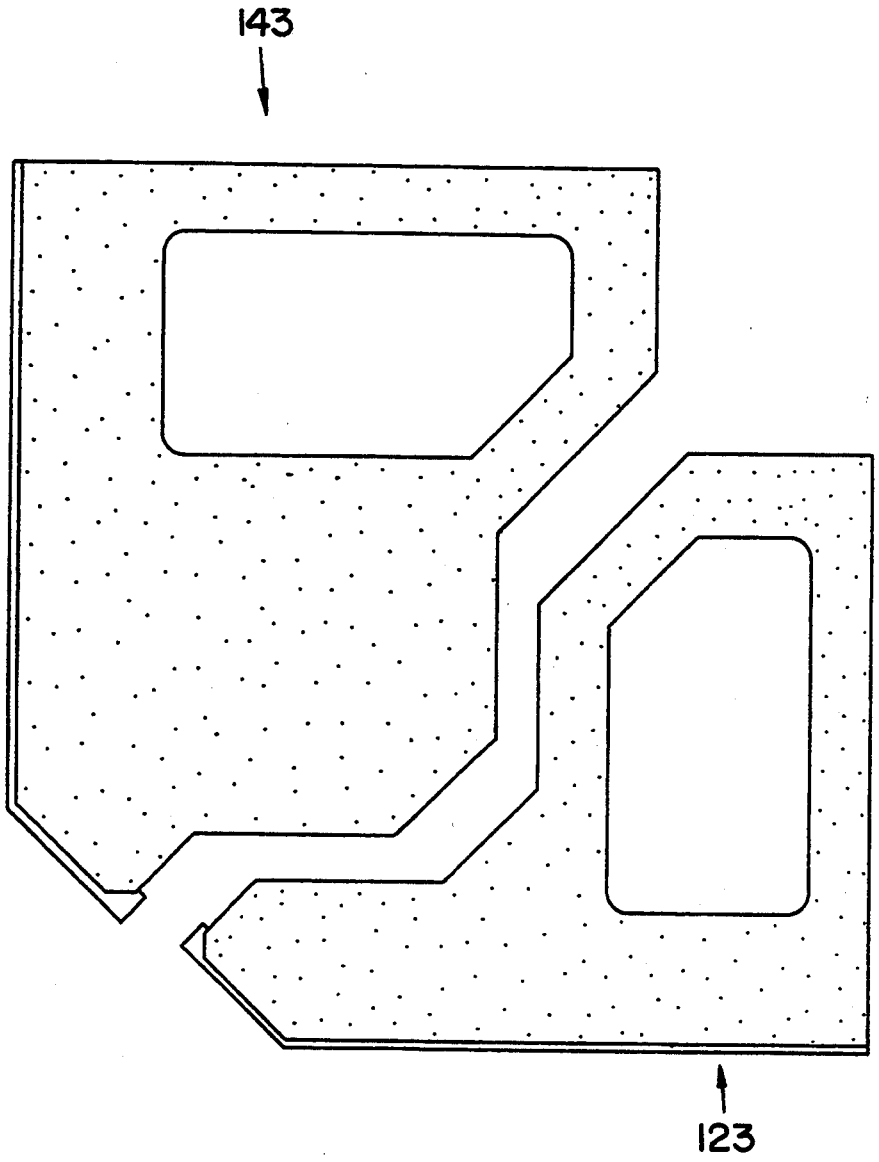
FIG. 13 is a top elevational view of the masonry units for FIGS. 11 and 12 juxtaposed.

FIG. 12 is a top elevational view of a masonry unit having a protuberance portion that is designed to mate with cut out portion of the side wall in FIG. 11. The masonry unit includes a glaze 142 on the front face 143 of the masonry block 141. As discussed above, this embodiment of the present invention can be provided in the form of an unglazed or raw block as well as a glazed block shown in this FIG. 12.

The front face of the masonry block includes a planar portion 144 that is opposite to and preferably extends parallel to a back face 145. The front face also includes a second segment 146 that intersects the planar portion 144 at an obtuse, acute or right angle A depending upon the angle of the desired corner. In a preferred aspect according to the present invention, angle A is obtuse and most preferably about 135°.

In addition, it is essential in achieving the desired results obtained by the present invention that the second segment of the front face or return 146 be shorter than the planar portion 144 of the front face and preferably have a length that is about 75% or less of the planar portion of the front face, more preferably about 5% to about 50% of the planar portion of the front face and most preferably about 5% to 25% of the planar portion of the front face. Preferably, the second segment or return 146 is 2½" or less and usually at least about ½" and most preferably about 1" to about 2". In this embodiment, the second segment is about 1.75 inches. The planar portion 144 of the front face is about 12.50 inches.

Side face 148 is angled and intersects the back face 145 and second segment 146 of the front face 143. Side face 148 forms an obtuse angle C with the back face 145, and in preferred aspect of the present invention, angle C is about 135°. In addition, side face 148 forms an angle B with the second segment 146 which can be a right angle, an acute angle or an obtuse angle depending upon the intended use of the block. In the most preferred aspects of the present invention, angle B is about 90°. However, it may be acute or obtuse depending upon its intended use.

Side face 148 includes segments 151 and 152 with protuberance 153 located therebetween. In this embodiment segment 151 is about 1.75 inches long, segment 152 is about 5.75 inches long and protuberance 153 is about 6.875 inches wide at its protuberance 153 is tapered and includes opposing side walls 154 and 155 which in this embodiment are about 3.625 inches long. Side walls 154 and 155 intersect segments 151 and 152, respectively, at an angle E which is preferably but not necessarily a 135° angle. Also side walls 154 and 155 intersect walls 156, respectively at angles F and G. Angles F and G in this embodiment are each about 135°.

The intersection between side face 148 and the second segment 146 of the raw block only is truncated as shown by segment 149, which in this embodiment is about 0.25 inches.

According to preferred aspects of the present invention, a return edge or lip of a minor portion 148A of angled side wall 148 that intersects the second segment of the front face is also glazed. Typically this glazed portion 148A is about ⅛ inch to about 1 inch. The glazed portion 148A provides for a more finished look to the corner since there is a molded corner at the point of intersecting sides 146 and 148 and also provides for a joint that is less susceptible to chipping.

In addition, in a preferred aspect of the present invention, a minor portion (not shown) of top face 150 is also glazed with the glazing composition. Typically this glazed portion is about ½ inch to about 1 inch regardless of the width of the top face. The bottom face (not shown) is opposite the top face 150 and preferably parallel to the top face as in conventional masonry units.

The length of the second segment (return) 146 is shorter than that of the side face 147 and is preferably about 75% or less of the length of the side face 147 and more preferably about 5% to about 50% of the side face 147, and most preferably about 5% to about 25% of the side face 147.

In this embodiment, side face 147 (unglazed) is about 11.625" long and about 11.75 inches long with the glaze, and back face 145 is about 2.60 inches long.

The reinforced embodiments pursuant to the present invention also provide for enhanced fire retardancy. Moreover, such embodiments can be further modified to provide means for receiving horizontal reinforcement rods to thereby provide masonry unit processing increased reinforcement to provide for tying the corner construction together. (See FIG. 14.) This masonry unit includes a front face 163 that includes a planar portion 164 that is opposite to and preferably extends parallel to a back face 165.

The front face also includes a second segment 166 that intersects the planar portion 164 at an obtuse, acute or right angle A depending upon the angle of the desired corner. In a preferred aspect according to the present invention, such angle is obtuse and most preferably about 135°.

In addition, the second segment of the front face or return 166 should be shorter than the planar portion of the front face and preferably have a length that is about 75% or less of the planar portion of the front face, more preferably about 5% to about 50% of the planar portion of the front face and most preferably about 5% to 25% of the planar portion of the front face. Preferably, the second segment or return 166 is 2½" or less and usually at least about ½" and most preferably about 1" to about 2".

Side face 168 is angled and intersects the back face 165 and second segment 166 of the front face 163. Side face 168 forms an obtuse angle C with the back face 165, and in preferred aspect of the present invention, such angle n is about 135°. In addition, side face 168 forms an angle with the second segment 166 which can be a right angle, an acute angle or an obtuse angle depending upon the intended use of the block. In the most preferred aspects of the present invention, such angle is about 90°. However, it may be acute or obtuse depending upon its intended use.

Side face 168 includes segments 171 and 172 with cut out portion 173 located therebetween.

The web 174 includes means at its extremities for receiving horizontally placed reinforcement rods (not shown) that will be held in place when cement is poured into web 174 and cut out portion 173. The receiving means include valleys 175 provided at the ends of web 174.

Figure 14:
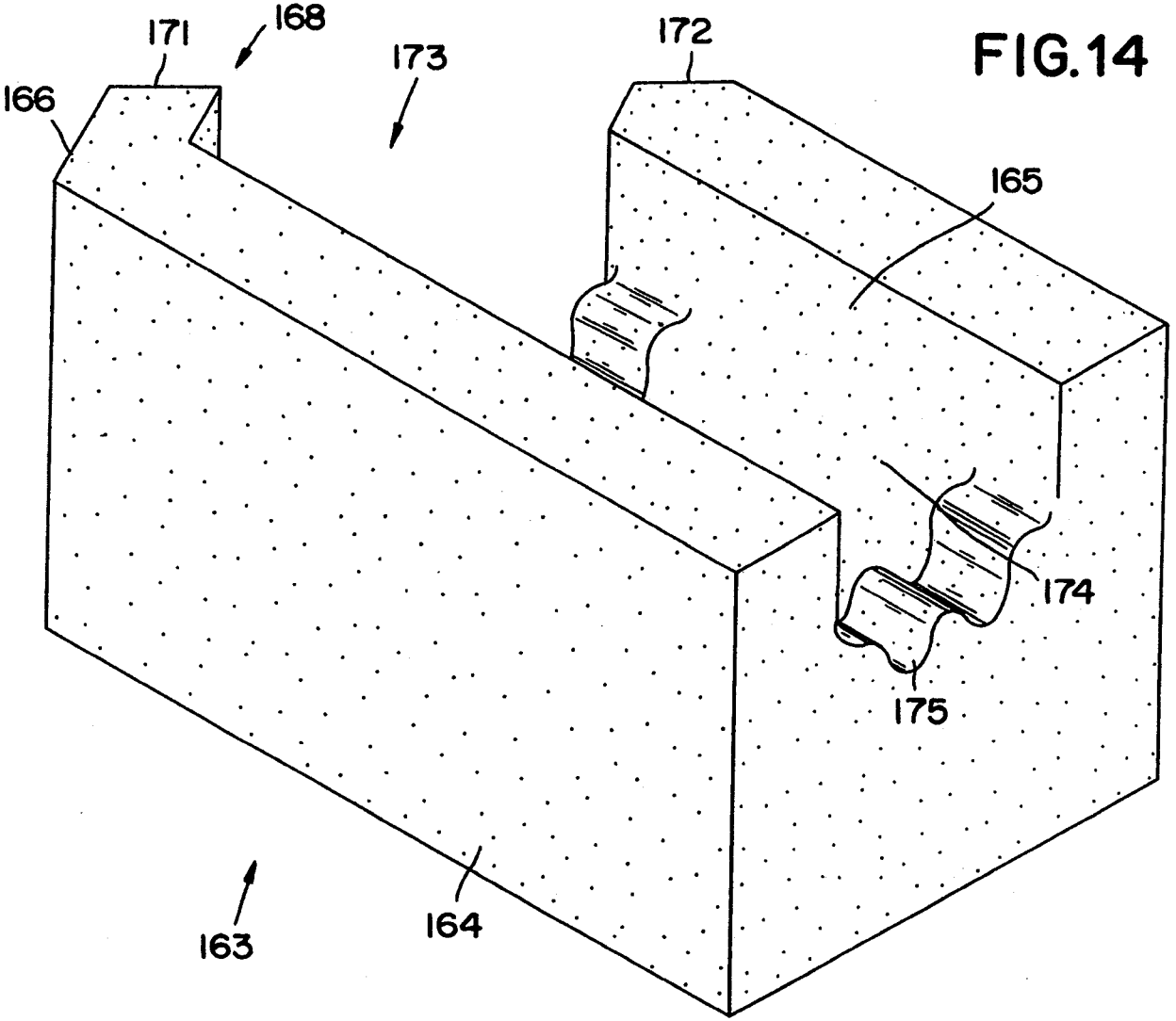
FIG. 14 is an isometric view of a glazed masonry unit having a cut out portion in a side wall commonly referred to as a web wall pursuant to an alternative embodiment of the present invention.

Masonry units along the lines of FIG. 14 are suitable for use in earthquake construction.

Masonry units along the lines of FIG. 14 are suitable for use in earthquake construction.

Figure 17:
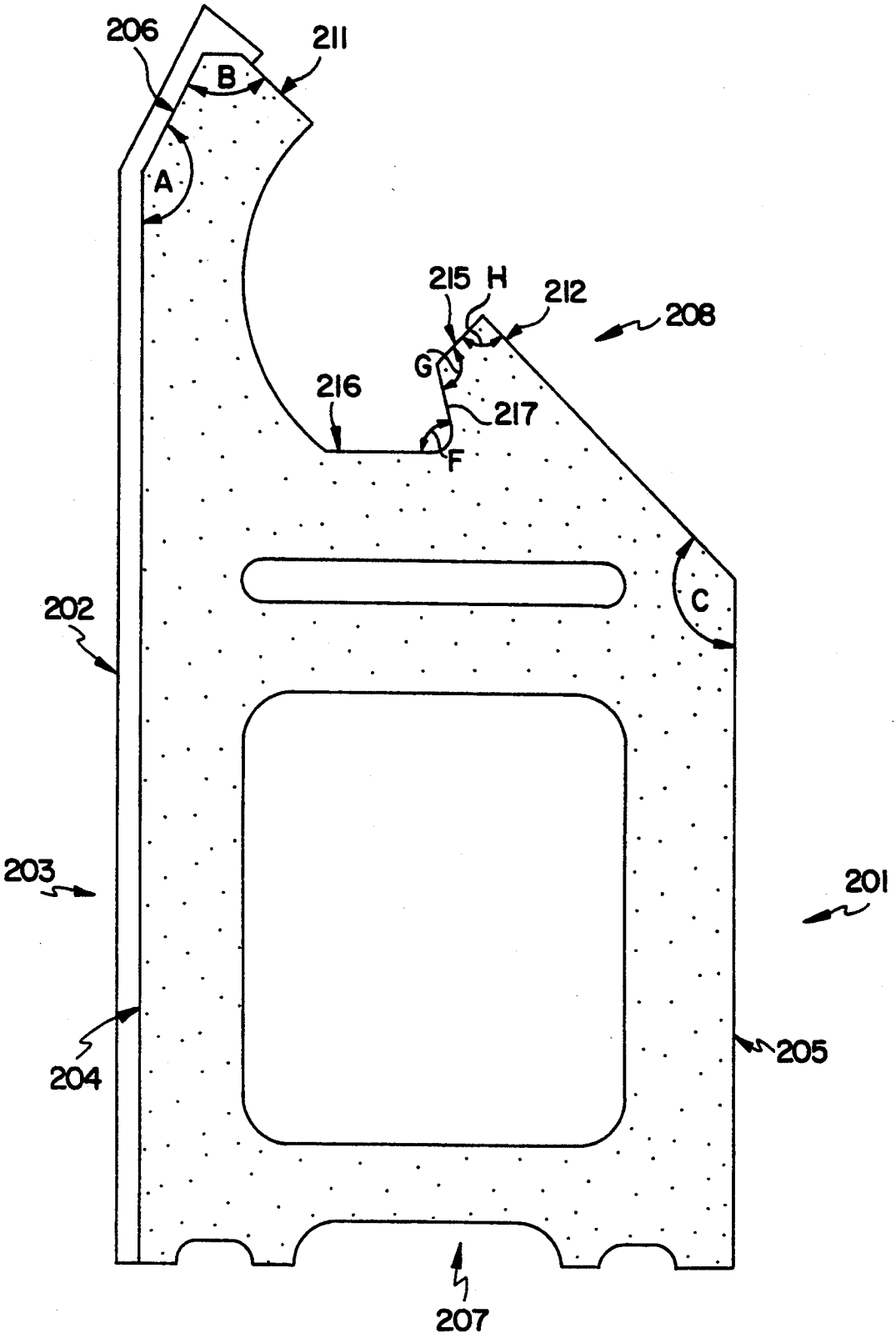
FIG. 17 is a top elevational view of a masonry unit having a cut out portion in a side wall pursuant to an alternative embodiment of the present invention.
Figure 18:
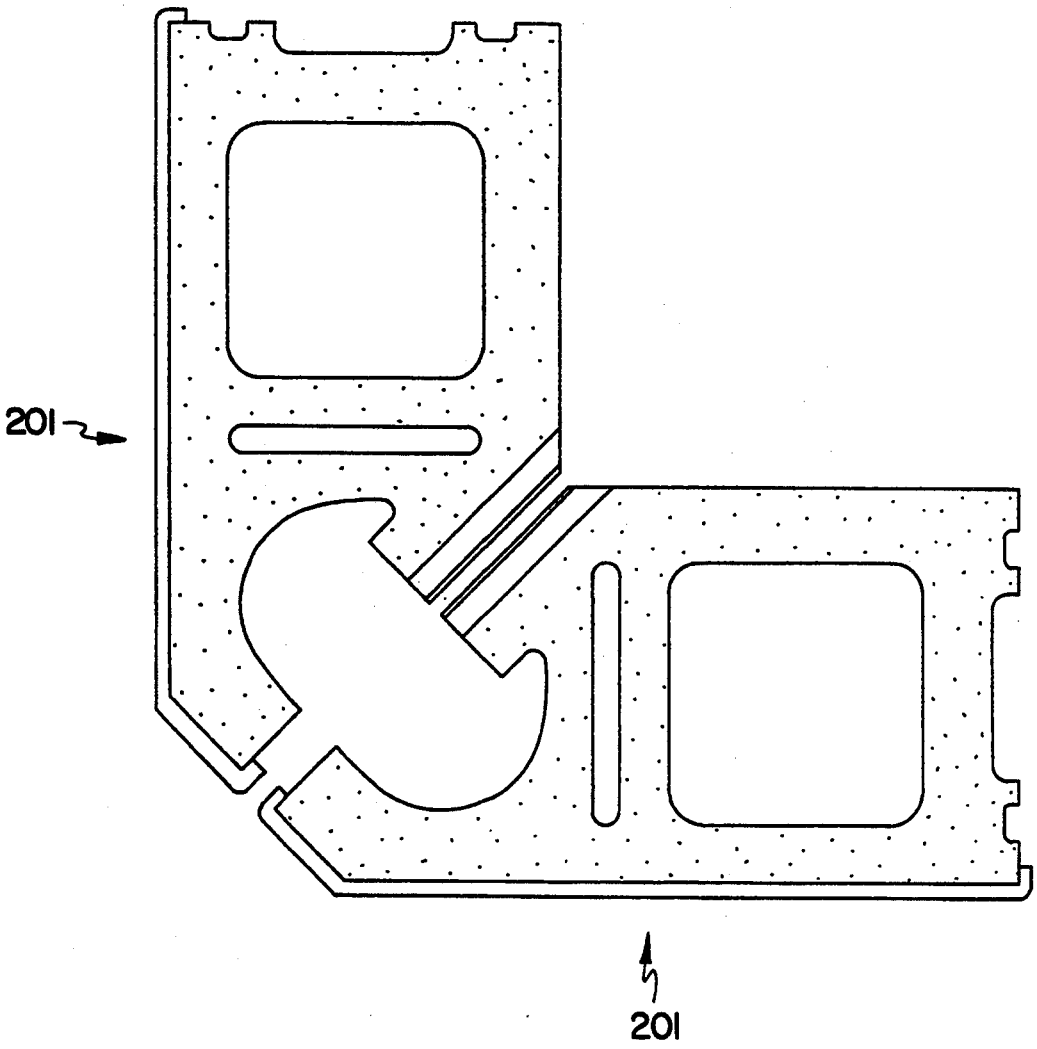
FIG. 18 is a top elevational view of a corner turn employing two of the masonry units pursuant to FIG. 17.

FIG. 17 is a top elevational view of a masonry unit having a cut out portion in a side wall. The cut out portion of this embodiment provides for enhanced structural reinforcement of a corner fabricated using such unit. The reinforcement can be provided by providing a mortar bed in the recess (e.g.—"buttering the joint") or pouring cement into the recess created by the cut out portion, and if desired, reinforcing rods or other such structure can also be provided in the recess. The presence of the projection or "ear-like" portion in the cut out portion provides for a physical interlock of adjoining masonry units (see FIG. 18).

The cut out portion merely needs to be large enough to provide the desired additional strength with the maximum size being primarily limited by merely assuring the integrity of the block during handling and construction and by economics. In addition, the location of the cut out portion is typically such that the length of the side wall adjacent to each end of the cut out portion is at least about 1½ inches and preferably at least about 1.625 inches to insure against a portion of the block breaking off during handling and construction. The additional projection in the cut out portion typically extends at least about ⅛" beyond main body of the cut out portion. The specific dimensions for the cut out portion and location for a particular embodiment can be determined by those skilled in the art once aware of this disclosure without undue experimentation.

FIG. 17 is a top elevational view of a 8 inch corner masonry unit pursuant to the present invention that includes a glaze 202 on the front face 204 of the masonry block 201.

This embodiment of the present invention can be provided in the form of an unglazed or raw block as well as a glazed block shown in this figure. The front face of the masonry block includes a planar portion 204 that is opposite to and preferably extends parallel to a back face 205. The front face also includes a second segment 206 that intersects the planar portion 204 at an obtuse, acute or right angle A depending upon the angle of the desired corner. In a preferred aspect according to the present invention, angle A is obtuse and most preferably about 135°.

In addition, it is essential in achieving the desired results obtained by the present invention that the second segment of the front face or return 206 be shorter than the planar portion 204 of the front face and preferably have a length that is about 75% or less of the planar portion of the front face, more preferably about 5% to about 50% of the planar portion of the front face and most preferably about 5% to 25% of the planar portion of the front face. Preferably, the second segment or return 206 is 2½" or less and usually at least about ½" and most preferably about 1" to about 2". In this embodiment, the second segment is about 1.675 inches. The planar portion 204 of the front face is about 12.25 inches.

Side face 208 is angled and intersects the back face 205 and second segment 206 of the front face 203. Side face 208 forms an obtuse angle C with the back face 205, and in preferred aspect of the present invention, angle C is about 135°. In addition, side face 208 forms an angle B with the second segment 206 which can be a right angle, an acute angle or an obtuse angle depending upon the intended use of the block. In the most preferred aspect of the present invention, angle B is about 90°. However, it may be acute or obtuse depending upon its intended use.

Side face 208 includes segments 211 and 212 with cut out portion 213 located therebetween. In this embodiment segment 211 is about 1.75 inches long, segment 212 is about 4.0 inches long and cut out portion 213 includes opposing side wall 214 and 215. In this embodiment wall 215 is about 0.75 inches long. Side wall 215 intersects segment 216. Side wall 214 intersects projection 217.

Projection 217 is recessed and extends beyond the main body of cut-off portion 213 and beyond one of the side walls of the cut out portion. In FIG. 17, projection 217 extends beyond side wall 215 towards backs walls 205. The projection upon application of mortar or cement provides for a mechanical interlocks which cannot be pulled apart without destroying the block itself.

Angles F, G and H are 75°, 120°, and 90°, respectively in this embodiment.

The intersection between side face 208 and the second segment 206 of the raw block only is truncated as shown by segment 229, which is this embodiment is about 0.375 inches.

The length of the second segment (return) 206 is shorter than that of the side face 207 and is preferably about 75% or less of the length of the side face 207 and and more preferably about 5% to about 50% of the side face 207, and more preferably about 5% to about 25% of the side face 207.

In this embodiment side face 207 (unglazed) is about 7.625" and about 7.75 inches long with the glaze, and back face 205 is about 7.5 inches long.

Figure 15:
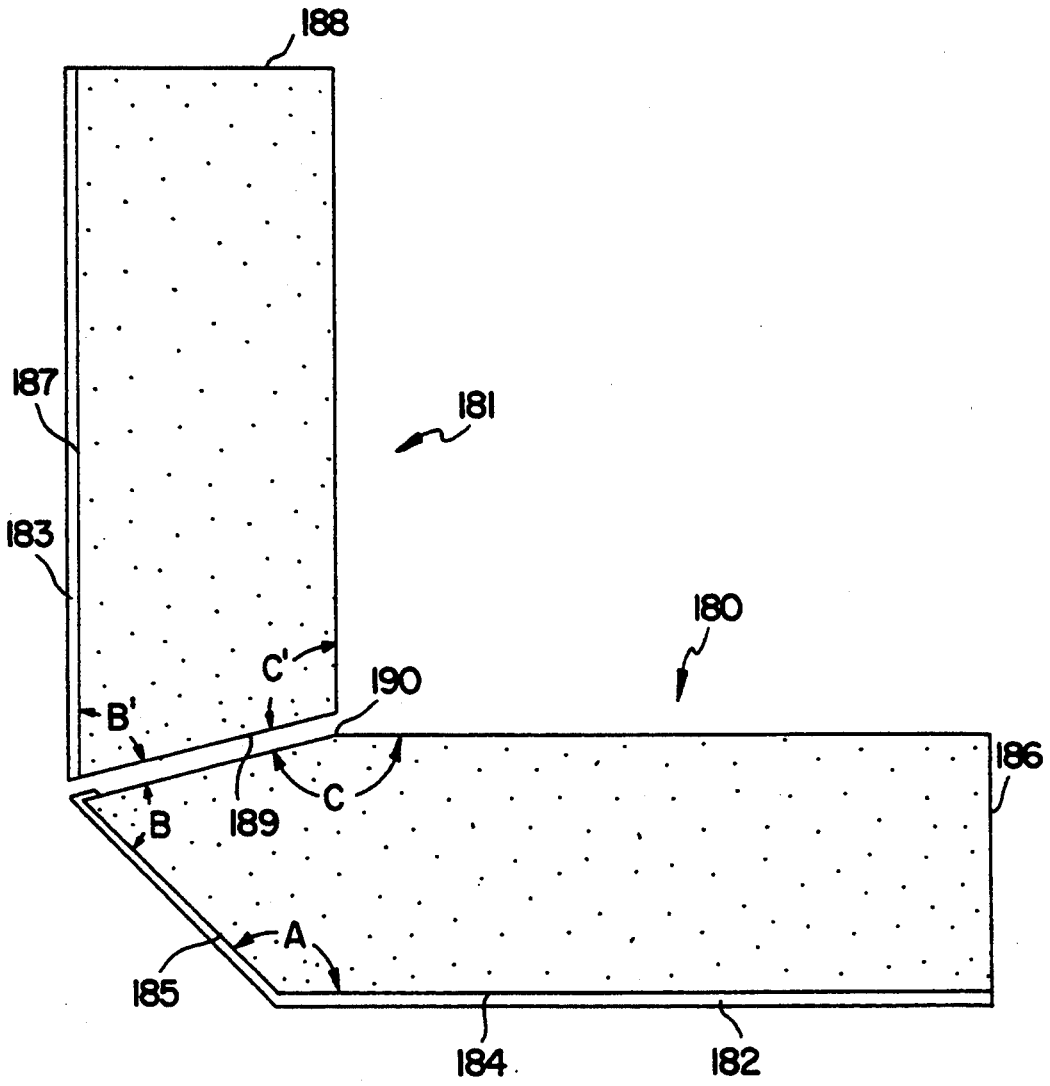
FIG. 15 is a top elevational view of an alternative embodiment for creating a corner turn.

Reference to FIG. 15 illustrates a further embodiment of the present invention whereby a corner turn is constructed employing one of the angled masonry units 180 having glaze 182 thereon as described above and a glazed stretcher block 181 having glaze 183 thereon, the block being mitred to complement the angled side face of the glazed masonry unit. In this type of construction, angle B is acute, a typical example for turning a 90° corner is about 59°. In any event, the sum of angles A, B and B′ will be complementary of the corner that is to be turned. For instance in the event of a 90° turn, the sum of angles A, B and B′ will be 270°. In such an example, angle A is typically about 135° and when angle B is about 59° than angle B′ will be about 76°. In addition the sum of angles C and C′ will be complementary of the angle of the turn. For instance in the event of a 90° turn, the sum of C and C′ will be about 270°, and more typically each of angles C and C′ will be about 135°. In the specific example illustrated in FIG. 15, the length of planar surface 184 is about 11.75 inches, the length of segment 185 is about 3.75 inches and the length of side face 186 is about 3.75 inches. Front face 187 of stretcher 181 is about 11.75 inches and side face 188 is about 3.75 inches.

Side face 189 of stretcher 181 is mitred to complement and extend parallel to angled side face 190 of block 180.

In constructing a wall employing the construction of FIG. 15, it might be desirable to alternate adjacent layers as the wall is constructed. In other words, a stretcher block 181 would be placed atop an angled glazed block 180 and an angled glazed block 180 would be placed atop a stretcher block as the construction of a wall continues upwardly.

Figure 16:
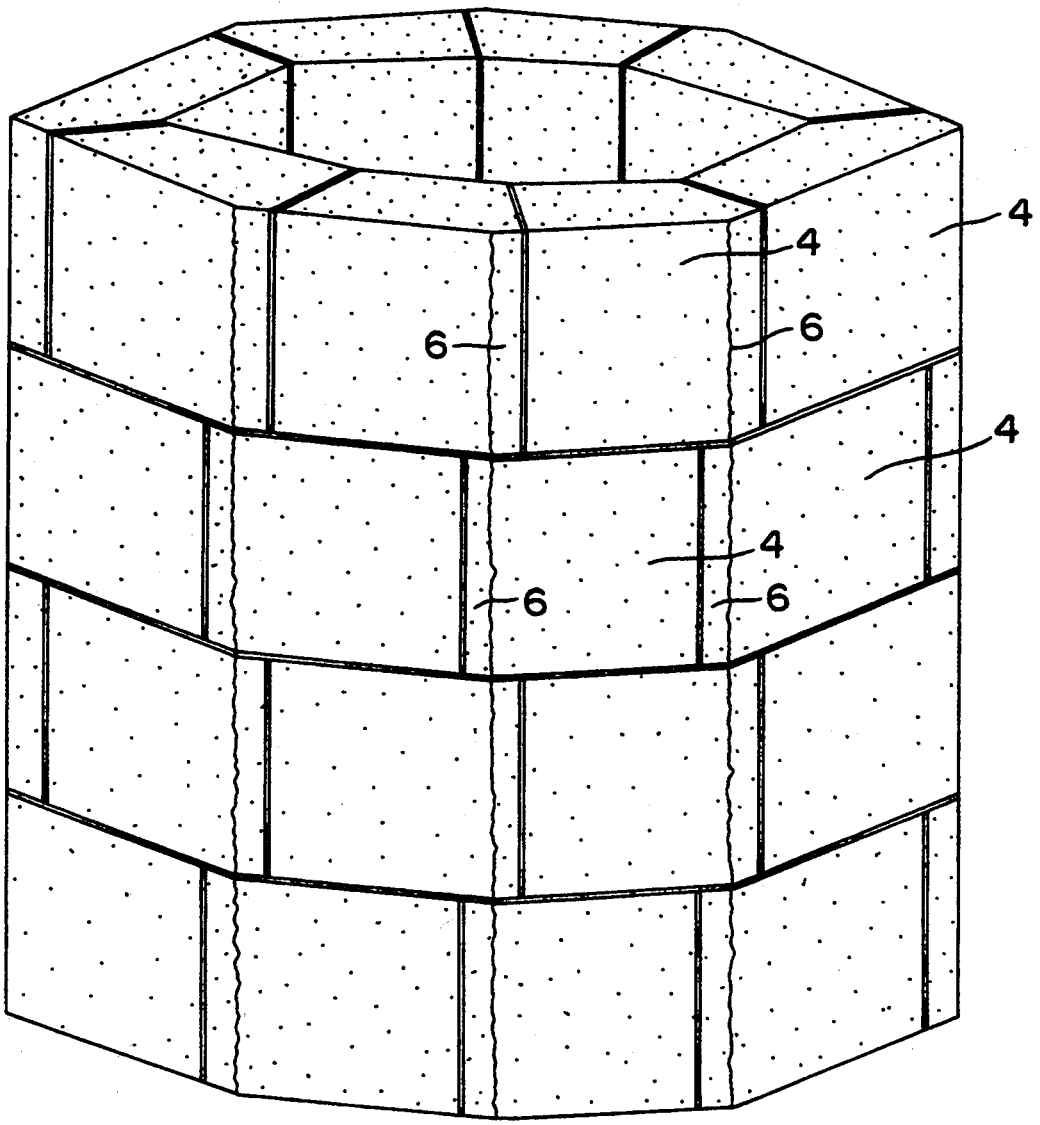
FIG. 16 is an isometric view of a column pursuant to the present invention.

FIG. 16 illustrates a column fabricated from angled glazed blocks of the present invention. Of course any of the types of angled glazed blocks of the present invention as disclosed hereinabove could be employed. The blocks are oriented to each other so that angled side face 8 of one glazed block is opposed side face 7 of an adjacent glazed block. In addition, in FIG. 16, adjacent rows of blocks lie in opposite direction from each other in order to stagger the mortar joint in the horizontal direction of the column. If desired, the rows of blocks can lie in the same direction or any combination of the same and opposite directions. In FIG. 16, the angle A of of each block is about 135°. Therefore 8 blocks are required for achieving a complete 360° column. The number of blocks for achieving a complete 360° column is readily determined by those skilled in the art without undue experimentation. In particular, one merely needs to divide 360° by the complementary angle to angle A. It is further noted that if desired, the present invention can be used to provide only a portion of a 360° column.

While the present invention has been described with respect to various preferred aspects thereof, it will be appreciated that the present invention can be implemented in a number of different ways by those skilled in the art once aware of the present disclosure to suit particular requirements. It will be understood that various changes and substitutions may be made within the spirit and scope of the invention as defined in the following claims.

What is claimed is:

1. A column composite or portion thereof comprising at least two glazed angled masonry building units each having an angled return portion wherein each glazed masonry building unit comprises a front face, a back face, a top face, a bottom face and two side faces wherein said front face is glazed with a resinous composition and is intended to be exposed and comprises a planar portion that is opposite to said back face and a second segment that intersects said planar portion to thereby form an obtuse, acute or right angle and wherein the length of said second segment is shorter than the length of said planer portion;

one of said side faces being angled and intersecting said second segment and said back face forming an obtuse angle with said back face and forming an angle with said second segment, and wherein the angled side face of one of the glazed units is opposed the opposite side face of an adjacent second glazed unit.

2. The composite of claim 1 wherein the length of said second segment is about 75% or less of the length of said planar portion.

3. The composite of claim 1 wherein the length of said second segment is about 5% to about 50% of said planar portion.

4. The composite of claim 1 wherein the length of said second segment is about 5% to about 25% of said planar portion.

5. The composite of claim 1 wherein the length of said second segment is less than the length of the side face.

6. The composite of claim 1 wherein the length of said second segment is about 75% or less of the length of said side face.

7. The composite of claim 1 wherein the length of said second segment is about 5% to about 50% of said side face.

8. The composite of claim 1 wherein the length of said second segment is about ½ inch to about 2½ inches.

9. The composite of claim 1 wherein the length of said second segment is about 1 inch to about 2 inches.

10. The composite of claim 1 wherein a return lip of a minor portion of the angled side wall that intersects said front face is also glazed.

11. The composite claim 10 wherein a minor portion of the top face or bottom face or both is glazed.

12. The composite of claim 11 wherein said minor portion is about ½ inch to about 1 inch.

13. The composite of claim 1 wherein a minor portion of the top face or bottom face or both is glazed.

14. The composite of claim 13 wherein said minor portion is about ½ inch to about 1 inch.

15. The composite of claim 10 wherein said return lip is about ½ inch to about 1 inch.

16. The composite of claim 1 wherein the angle at the intersection of the second segment and planar portion is an obtuse angle.

17. The composite of claim 16 wherein the obtuse angle at the intersection of the angled side face and said back face is about 135°.

18. The composite of claim 1 wherein the obtuse angle at the intersection of the angled side face and said back face is about 135°.

19. The composite of claim 17 wherein the angle at the intersection of the angled side face and said second segment is about 90°.

20. The composite block of claim 1 wherein the angle at the intersection of the angled side face and said back face is about 90°.

21. The composite of claim 1 being a 360° column.

22. A column composite or portion thereof comprising at least two glazed angled masonry building units each having an angled return portion and wherein each glazed masonry building unit comprises a front face, a back face, a top face, a bottom face and two side faces wherein said front face is glazed with a resinous composition and is intended to be exposed and comprises a planar portion that is opposite to said back face and a second segment that intersects said planar portion to thereby form an obtuse, acute or right angle and wherein the length of said second segment is shorter than the length of said planer portion;

one of said side faces being angled and intersecting said second segment and said back face forming an obtuse angle with said back face and forming an angle with said second segment, and wherein a return lip of a minor portion of the angled side wall that intersects said front face is glazed, and wherein the angled side face of one of the glazed units is opposed the opposite side face of an adjacent second glazed unit.

23. The composite of claim 22 wherein the length of said second segment is about 75% or less of the length of said planar portion.

24. The composite of claim 22 wherein the length of said second segment is about 5% to about 50% of said planar portion.

25. The corner composite of claim 22 wherein the length of said second segment is about 5% to about 25% of said planar portion.

26. The composite of claim 22 wherein a minor portion of the top face or bottom face or both is glazed.

27. The composite of claim 22 wherein said minor portion is about ½ inch to about 1 inch.

28. The composite of claim 22 wherein said return lip is about ½ inch to about 1 inch.

29. The composite of claim 1 wherein the angle at the intersection of the second segment and planar portion is about 135°.

30. The composite of claim 22 wherein the obtuse at the intersection of the second segment and planar portion is about 135° .

31. The composite of claim 22 wherein the angle at the intersection of the second segment and planar portion is obtuse.

32. The wall corner composite of claim 30 wherein the obtuse angle at the intersection of the angled side face and said back face is about 135°.

33. The composite of claim 22 wherein the obtuse angle at the intersection of the angled side face and said back face is about 135°.

34. The composite of claim 33 wherein the angle at the intersection of the angled side face and said second segment is about 90°.

35. The composite of claim 22 wherein the angle at the intersection of the angled side face and said back face is about 90°.

36. An angled masonry building unit for fabricating a structurally reinforced corner comprising a front face, a back face, a top face, a bottom face and two side faces comprises a planar portion that is opposite to said back face and a second segment that intersects said planar portion to thereby form an obtuse, acute or right angle; one of said side faces being angled and intersecting said second segment and said back face forming an obtuse angle with said back face and forming an angle with said second segment and further including a cut out portion interposed between said front face and said back face; wherein said cut out portion includes a recessed projection.

37. The masonry building unit of claim 36 wherein said front face is glazed with a resinous composition and is intended to be exposed; and wherein the length of said second segment is shorter than the length of said planar portion and is about 2½ inches or less.

38. The angled masonry building unit of claim 36 wherein the length of the side wall adjacent to each end of said cut out portion is at least about 1½ inches.

39. The angled masonry building unit of claim 36 wherein the angle at the intersection of the second segment and planar portion is an obtuse angle.

40. The angled masonry building unit of claim 36 wherein the obtuse angle at the intersection of the angled side face and said back face is about 135°.

41. The angled masonry building unit of claim 36 wherein the obtuse angle at the intersection of the angled side face and said back face is about 135°.

42. A wall corner composite comprising at least two of the masonry building units according to claim 36 wherein the angled return portion of each unit face each other, and wherein the cut out portions contain cement.

43. The angled masonry building unit of claim 36 which further comprises means for receiving horizontally placed reinforcement rods.

44. The angled masonry building unit of claim 36 wherein said projection extends beyond the main body of said cut off portion and beyond a side wall of said cut off portion.

45. The angled masonry building unit of claim 44 wherein said projection extends toward the back wall.

46. The composite of claim 1 wherein said second segment is about 2½ inches or less.

47. The composite of claim 42 wherein said cut out portions include projections that extend toward the back wall and along with the cement provide for an interlocking joint.

* * * * *